United States Patent [19]

Zandona et al.

[11] 4,414,098

[45] Nov. 8, 1983

[54] UPGRADING CARBO-METALLIC OILS WITH USED CATALYST

[75] Inventors: Oliver J. Zandona, Ashland; William P. Hettinger, Jr., Russell, both of Ky.

[73] Assignee: Ashland Oil, Inc., Ashland, Ky.

[21] Appl. No.: 288,572

[22] Filed: Jul. 30, 1981

[51] Int. Cl.[3] ..... C10G 11/18

[52] U.S. Cl. ..... 208/120; 208/91; 208/251 R; 208/74

[58] Field of Search ..... 208/74, 91, 120, 251 R

[56] References Cited

U.S. PATENT DOCUMENTS

| | | | |
|---|---|---|---|
| 3,409,541 | 11/1968 | Flanders et al. | 208/120 |
| 4,263,128 | 4/1981 | Bartholic | 208/91 |
| 4,331,533 | 5/1982 | Dean et al. | 208/113 |
| 4,332,674 | 6/1982 | Dean et al. | 208/120 |
| 4,336,160 | 6/1982 | Dean et al. | 252/417 |
| 4,354,923 | 10/1982 | Myers et al. | 208/113 |

OTHER PUBLICATIONS

Shankland and Schmitkons, "Determination of Activity & Selectivity of Cracking Catalyst", Proc. API 27 (III) 1947, pp. 57–77.

*Primary Examiner*—Delbert E. Gantz
*Assistant Examiner*—G. E. Schmitkons
*Attorney, Agent, or Firm*—Richard C. Willson, Jr.

[57] ABSTRACT

A process is disclosed for upgrading a hydrocarbon oil feed having a significant content of metals, especially vanadium, to provide a higher grade of oil products by contacting the feed under sorbing conditions in an upgrading zone with a high surface area, high pore volume sorbent material containing an added alkaline metal to neutralize acidic cracking sites. Upgrading conditions are such that coke and metals are deposited on the sorbent in the upgrading zone. Coked sorbent is regenerated by contact with an oxygen containing gas under regeneration conditions to remove the coke, and regenerated sorbent is recycled to the upgrading zone for contact with fresh feed. The added alkaline metal is present on the sorbent in an amount sufficient to neutralize substantially all of the acidic cracking sites and provide a sorbent material having a MAT relative activity in the range of about 0 to about 1 percent. A sorbent composition disclosed comprises a deactivation, spent or equilibrium catalyst withdrawn from an FCC or RCC cracking operation and treated with an alkaline metal additive during the upgrading process and/or prior to use in the upgrading process by impregnation techniques. The alkaline metal additives include water soluble inorganic salts and/or hydrocarbon soluble organo-metallic compounds of select alkaline metals.

33 Claims, 7 Drawing Figures

MRS UNIT-CONTACTOR / COMBUSTOR SYSTEM

MAT. CONVERSION VS. RELATIVE ACTIVITY as %
REFERENCE CATALYST CONVERSION : 75%
DAVISON FEEDSTOCK
MAT. CONVERSION, VOL. %
90
85
80
80
70
60
50
40
40
30
20
10
0
150
200
250
300
350
400
450
500
550
0
20
40
60
80
100
120
140
160
180
200
0
0.2
0.4
0.6
0.8
1.0
1.2
1.4
1.6
1.8
2.0
RELATIVE ACTIVITY as %

MRS UNIT-CONTACTOR / COMBUSTOR SYSTEM

ORDINARY SORBENT vs. SELECT SORBENT
CLUMPING-COALESCENCE TESTS
AT VARYING VANADIUM LEVELS

METAL TORTURE TEST (CIS)
CATALYST "D"

UPGRADING CARBO-METALLIC OILS WITH USED CATALYST

TECHNICAL FIELD

This invention is concerned with producing a higher grade petroleum oil having lowered contaminating metals and Conradson carbon values from a poor grade of petroleum oil comprising a carbo-metallic oil having high metals and Conradson carbon values. More particularly, this invention relates to the use of solid sorbent particulates for contacting the oil to affect a substantial reduction in the levels of undesired metals and coke precursors that contribute to losses of selective cracking activity in hydrocarbon conversion catalysts.

BACKGROUND OF THE INVENTION

The introduction of catalytic cracking to the petroleum industry in the 1930's constituted a major advance over previous techniques with the object of increasing the yield of gasoline and its quality. Early fixed bed, moving bed, and fluid bed (FCC) catalytic cracking processes employed vacuum gas oils (VGO) from crude sources that were considered sweet and light. The terminology of sweet refers to low sulfur content and light refers to the amount of material boiling below approximately 1,000°-1,025° F.

The catalysts employed in early homogeneous fluid dense beds were of an amorphous siliceous material, prepared synthetically or from naturally occurring materials activated by acid leaching. Tremendous strides were made in the 1950's in FCC technology in the areas of metallurgy, processing equipment, regeneration and new, more-active and more stable amorphous catalysts. However, increasing demand with respect to quantity of gasoline and increased octane number requirements to satisfy the new high horsepower-high compression engines being promoted by the auto industry put extreme pressure on the petroleum industry to increase FCC capacity and severity of operation.

A major breakthrough in FCC catalysts came in the early 1960's with the introduction of molecular sieves or zeolites. These materials were incorporated into the matrix of amorphous and/or amorphous/kaolin materials constituting the FCC catalysts of that time. These new zeolitic catalysts, containing a crystalline aluminosilicate zeolite in an amorphous matrix of silica, alumina or silica-alumina, with or without kaolin or other clays or the like, were at least 1,000-10,000 times more active for cracking hydrocarbons than the earlier amorphous catalysts containing silica and/or alumina, with or without kaolin or other clays. This introduction of zeolitic cracking catalysts revolutionized the fluid catalytic cracking process. New innovations were developed to handle these high activities, such as riser cracking, shortened contact times, new regeneration processes, new improved zeolitic catalyst developments, and the like.

The new catalyst developments revolved around the development of various zeolites such as synthetic types X and Y and naturally occurring faujasites; increased thermal-steam (hydrothermal) stability of zeolites through the inclusion of rare earth ions or ammonium ions via ion-exchanged techniques; and the development of more attrition resistant matrices for supporting the zeolites.

These zeolitic catalyst developments gave the petroleum industry the capability of greatly increasing throughput of feedstock with increased conversion and selectivity while employing the units without expansion and without requiring new unit construction.

After the introduction of zeolite containing catalysts, the petroleum industry began to suffer from a lack of crude availability as to quantity and quality accompanied by increasing demand for gasoline with increasing octane values. The world crude supply picture changed dramatically in the late 1960's and early 1970's. From a surplus of light, sweet crudes the supply situation changed to a tighter supply with an ever increasing amount of heavier crudes with higher sulfur contents. These heavier and higher sulfur crudes presented processing problems to the petroleum refiner in that these heavier crudes invariably also contained much higher metals and Conradson carbon values, with accompanying significantly increased asphaltic content.

Fractionation of the total crude to yield cat cracker charge stocks also required much better control to ensure that metals and Conradson carbon values were not carried overhead to contaminate the FCC charge stock. The effects of heavy metal and Conradson carbon on a zeolite containing FCC catalyst have been described in the literature as to their highly unfavorable effect in lowering catalyst activity and selectivity for gasoline production and their equally harmful effect on catalyst life.

As mentioned previously, these heavier crude oils also contained more of the heavier fractions and yielded less or lower volume of the high quality FCC charge stocks which normally boil below about 1,025° F. and are usually processed so as to contain total metal levels below 1 ppm, preferably below 0.1 ppm, and Conradson carbon values substantially below 1.0.

With the increasing supply of heavier crudes, which meant lowered yields of gasoline, and the increasing demand for liquid transportation fuels, the petroleum industry began a search for processing schemes to utilize these heavier crudes in producing gasoline. Many of these processing schemes have been described in the literature. These include Gulf's Gulfining and Union Oil's Unifining processes for treating residuum, UOP's Aurabon process, Hydrocarbon Research's H-Oil process, Exxon's Flexicoking process to produce thermal gasoline and coke, H-Oil's Dynacracking and Phillip's Heavy Oil Cracking (HOC) processes. These processes utilize thermal cracking or hydrotreating followed by FCC or hydrocracking operations to handle the higher content of metal contaminates (Ni-V-Fe-Cu-Na) and high Conradson carbon values of 5-15. Some of the drawbacks of these types of processing are as follows: Coking yields thermally cracked gasoline which has a much lower octane value than cat cracked gasoline and is unstable due to the production of gum from diolefins and requires further hydrotreating and reforming to produce a high octane product; gas oil quality is degraded due to thermal reactions which produce a product containing refractory polynuclear aromatics and high Conradson carbon levels which are highly unsuitable for catalytic cracking; and hydrotreating requires expensive high pressure hydrogen, multi-reactor systems made of special alloys, costly operations, and a separate costly facility for the production of hydrogen.

To better understand the reasons why the industry has progressed along the processing schemes described, one must understand the known and established effects of contaminant heavy metals (Ni-V-Fe-Cu), contaminant alkaline metals (Na) and Conradson carbon on the zeolite containing cracking catalysts and the operating parameters of a FCC unit. Heavy metal content and Conradson carbon are two very effective restraints on the operation of an FCC unit and may even impose undesirable restraints on a Reduced Crude Conversion (RCC) unit from the standpoint of obtaining maximum conversion, selectivity and life. Relatively low levels of these contaminants are highly detrimental to an FCC unit. As heavy metals and Conradson carbon levels are increased still further, the operating capcity and efficiency of an RCC unit may be adversely affected or made uneconomical. These adverse effects occur even though there is enough hydrogen in the feed to produce an ideal gasoline consisting of only toluene and isomeric pentenes (assuming a catalyst with such ideal selectivity could be devised).

The effect of increased Conradson carbon is to increase that portion of the feedstock converted to coke deposited on the catalyst. In typical VGO operations employing a zeolite containing catalyst in an FCC unit, the amount of coke deposited on the catalyst averages about 4–5 wt% of the feed. This coke production has been attributed to four different coking mechanisms, namely, contaminant coke from adverse reactions caused by metal deposits, catalytic coke caused by acid site cracking, entrained hydrocarbons resulting from pore structure adsorption and/or poor stripping, and Conradson carbon resulting from pyrolytic distillation of hydrocarbons in the conversion zone. There has been postulated two other sources of coke present in reduced crudes in addition to the four present in VGO. They are: (1) absorbed and adsorbed high boiling hydrocarbons which do not vaporize and cannot be removed by normally efficient stripping, and (2) high molecular weight nitrogen containing hydrocarbon compounds adsorbed on the catalyst's acid sites. Both of these two new types of coke producing phenomena add greatly to the complexity of resid processing. Therefore, in the processing of higher boiling fractions, e.g., reduced crudes, residual fractions, topped crude, and the like, the coke production based on feed is the summation of the four types present in VGO processing (the Conradson carbon value generally being much higher than for VGO), plus coke from the higher boiling unstrippable hydrocarbons and coke associated with the high boiling nitrogen containing molecules which are adsorbed on the catalyst. Coke production on clean catalyst, when processing reduced crudes, may be estimated as approximately 4–5 wt% of the feed plus the Conradson carbon value of the heavy feedstock.

The coked catalyst is brought back to equilibrium activity by burning off the deactivating coke in a regeneration zone in the presence of air, and the regenerated catalyst is recycled back to the reaction zone. The heat generated during regeneration is removed by the catalyst and carried to the reaction zone for vaporization of the feed and to provide heat for the endothermic cracking reaction. The temperature in the regenerator is normally limited because of metallurgical limitations and the hydrothermal stability of the catalyst.

The hydrothermal stability of the zeolite containing catalyst is determined by the temperature and steam partial pressure at which the zeolite begins to rapidly lose its crystalline structure to yield a low activity amorphous material. The presence of steam is highly critical and is generated by the burning of adsorbed and absorbed (sorbed) carbonaceous material which has a significant hydrogen content (hydrogen to carbon atomic ratios generally greater than about 0.5). This carbonaceous material is principally the high boiling sorbed hydrocarbons with boiling points as high as 1,500°–1,700° F. or above that have a modest hydrogen content and the high boiling nitrogen containing hydrocarbons, as well as related porphyrins and asphaltenes. The high molecular weight nitrogen compounds usually boil above 1,025° F. and may be either basic or acidic in nature. The basic nitrogen compounds may neutralize acid sites while those that are more acidic may be attracted to metal sites on the catalyst. The porphyrins and asphaltenes also generally boil above 1,025° F. and may contain elements other than carbon and hydrogen. As used in this specification, the term "heavy hydrocarbons" includes all carbon and hydrogen containing compounds that do not boil below about 1,025° F., regardless of whether other elements are also present in the compound.

As the Conradson carbon value of the feedstock increases, coke production increases and this increased load will raise the regeneration temperature; thus the unit may be limited as to the amount of feed that can be processed because of its Conradson carbon content. Earlier VGO units operated with the regenerator at 1,150°–1,250° F. A new development in reduced crude processing, namely, Ashland Oil's "Reduced Crude Conversion Process", as described in the pending U.S. applications referenced below, can operate at regenerator temperatures in the range of 1,350°–1,400° F. But even these higher regenerator temperatures place a limit on the Conradson carbon value of the feed at approximately 8, which represents about 12–13 wt% coke on the catalyst based on the weight of feed. This level is controlling unless considerable water is introduced to further control temperature, which addition is also practiced in Ashland's RCC processes.

For purposes of this application, the term "heavy metals" refers to nickel, vanadium, copper and iron, although small amounts of other heavy metal elements may sometimes be present. The metal containing fractions of crude oils contain these heavy metals in the form of porphyrins and asphaltenes. These metal containing hydrocarbons are deposited on the catalyst during processing and are cracked in the riser to deposit the metal or are carried over by the coked catalyst as the metallo-porphyrin or asphaltene and converted to the metal oxide during regeneration. Certain of these metals, particularly iron and copper, also may be present as the free metal or as inorganic compounds resulting from either corrosion of process equipment or contaminants from other refining processes. The adverse effects of these metals as taught in the literature are to cause nonselective or degradative cracking and dehydrogenation to produce increased amounts of coke and light gases such as hydrogen, methane and ethane. These mechanisms adversely effect selectivity, resulting in poor yields and quality of gasoline and light cycle oil. The increased production of light gases, while impairing the yield and selectivity of the processes, also puts an increased demand on the gas compressor capacity of the refinery. The increase in coke production, in addition to its negative impact on yield, also adversely affects catalyst activity and selectivity, greatly increases regenerator air demand and blower capacity, and may result in uncontrollable and/or dangerous regenerator temperatures.

The heavy metals transfer almost quantitatively from the feedstock oil to the catalyst particles and tend to deposit on interior and exterior surfaces of the particles where they can block and/or retard diffusion of the hydrocarbon molecules to the active, i.e., acidic, cracking sites of the catalyst. In addition, vanadium, and to a lesser extent nickel and the other heavy metals, can migrate to these acidic sites and poison or kill their catalytic cracking activity. Unless removed by desalting operations, as is the usual practice, sodium and other alkali or alkaline earth metals in the crude oil can diffuse to the acidic sites and also kill their catalytic activity.

These problems of the prior art have been greatly minimized by the development at Ashland Oil, Inc., of its Reduced Crude Conversion (RCC) Processes described in Ser. No. 094,092 (now U.S. Pat. No. 4,332,673) and the other copending applications referenced below and incorporated herein by reference. The new process can handle reduced crudes or crude oils containing high metals and Conradson carbon values previously not susceptible to direct processing. Normally, these crudes require expensive vacuum distillation to isolate suitable feedstocks and produce as a by-product, high sulfur containing vacuum still bottoms. Ashland's RCC processes avoid all of these prior art disadvantages. However, crudes such as Mexican Mayan or Venezuelan and certain other carbo-metallic oils and/or oil fractions may contain abnormally high metal and/or Conradson carbon values. If these poor grades of oil are processed in a reduced crude process, they will lead to an uneconomical operation because of the high load on the regenerator and/or the high catalyst replacement rates required to maintain catalyst activity and selectivity. The replacement rate can be as high as 4–8 lbs/bbl which, at today's catalyst prices, can add as much as $2–8/bbl of additional catalyst cost to the processing economics. On the other hand, it is desirable to develop an economical means of processing poor grade oils, such as the Mexican Mayan, because of their availability and cheapness as compared to Middle East crudes.

The literature suggests many processes for the reduction of metals content and Conradson carbon values of reduced crudes and other contaminated oil fractions. One such process is that described in U.S. Pat. No. 4,263,128 and German Patent No. 29 04 230 assigned to Engelhard Minerals and Chemicals, Inc., which patents are incorporated herein by reference. Basically, these prior art processes involve contacting a reduced crude fraction or other contaminated oil with sorbent at elevated temperature in a sorbing zone, such as a fluid bed, to produce a product of reduced metal and Conradson carbon value. One of the sorbents described in U.S. Pat. No. 4,263,128 is an inert solid initially composed of kaolin which has been spray dried to yield microspherical particles having a surface area of about 15 $m^2/g$ or less, low porosity, i.e., a pore volume of about 0.20 cc/gm or less, and a catalytic cracking micro-activity (MAT) value not substantially greater than 20, and which has been subsequently calcined at high temperature in an effort to achieve better attrition resistance. As the vanadia content on such sorbents increases into the range of 10,000–30,000 ppm, the sorbent begins to have fluidization problems which have been overcome previously by removal of most of the spent sorbent inventory and addition of fresh virgin material. This usually requires shutting down the sorbent contacting facility.

DISCLOSURE OF THE INVENTION

The invention is directed to the inclusion of one or more alkaline metal additives as a select metal oxide or salt into an FCC or RCC catalyst in an amount sufficient to lower its catalytic cracking activity to near zero. The catalyst is preferably a deactivated, spent or equilibrium catalyst which has been used previously in an FCC or RCC conversion operation.

The invention provides a method of producing a high grade of reduced crude conversion (RCC) feedstocks having lowered metals and Conradson carbon values from a poor grade of reduced crude or other carbo-metallic oil having extremely high metals and Conradson carbon values.

The invention may further be used for processing crude oils or crude oil fractions with significant levels of metals and/or Conradson carbon to provide an improved feedstock for typical fluid catalytic cracking (FCC) processes.

Crude oils or residual fractions from the distillation of crude oils may contain substantial amounts of heavy metals, such as Ni, V, Fe and Cu, and have high Conradson carbon values. These oils are made suitable for processing in a reduced crude conversion (RCC) process or a fluid catalytic cracking (FCC) process by preliminarily contacting the oil with a sorbent material exhibiting relatively low or no significant catalytic cracking activity at elevated temperatures to reduce the metals and Conradson carbon values.

As used throughout this specification, "vanadia" refers collectively to the oxides of vanadium. It has been found that as vanadium levels build up on a sorbent, the elevated temperatures encountered in the sorbent regeneration zone cause vanadia, particularly vanadium pentoxide ($V_2O_5$), to melt and liquid vanadia to flow. The melting and flowing of vanadia can, particularly at high levels and for sorbent materials with low surface areas and low pore volumes, coat the outside of sorbent microspheres with liquid vanadia and thereby adversely affect sorbent fluidization properties. Any interruption or decrease in particle flow may result in coalescence between the liquid coated sorbent particles. Once coalescence occurs, fluidization becomes difficult to reinitiate. This results in stoppage of flow in cyclone diplegs, ineffective operation of cyclones, rapid increases in the loss of the sorbent, and may finally result in unit shutdown.

According to the present invention, the adverse effects of vanadium are greatly reduced by contacting contaminated oil feeds with a sorbent having a relatively high pore volume and surface area to immobilize vanadium oxides by adsorbing deposited vanadia within the porous structure of the sorbent particles during feed pretreatment. The select sorbent of the invention is preferably a deactivated, spent or equilibrium (used) catalyst which has been treated with alkaline metal salts to neutralize residual acid cracking sites and yield a material which esssentially no catalytic cracking activity. Significant cracking activity is preferably avoided in the upgrading process to maximize the yield of high quality liquid product for use as feedstock in a subsequent FCC or RCC conversion process employing a highly selective cracking catalyst under optimum cracking conditions. This combination of upgrading and conversion processes substantially increases the yields of high octane liquid fuels from poor grades of crude or resid oils.

The method of addition of the alkaline metal additives to decrease the catalytic cracking activity of used FCC or RCC catalysts can be by addition during the upgrading process cycle or by impregnation of the catalyst particles, such as spray dried microspheres, prior to use in the process cycle. The resulting sorbent may possess less cracking activity than the previously mentioned and utilized sorbents and has a higher pore volume and a higher internal surface area to adsorb vanadia. Internal adsorption of vanadia deposited on the sorbent during processing of the oil for metal and/or Conradson carbon removal greatly reduces the tendency for particle coalescence at high vanadia loadings.

The invention thus provides an improved sorbent and an improved method for treatment of petroleum oil feeds containing significant levels of vanadium (at least about 1.0 ppm). More particularly, improved particle pore structure is provided in the sorbent to reduce particle coalescence and loss of fluidization caused by vanadium contaminants in oil feeds of all types utilized in FCC and/or RCC operations. Some crude oils and some FCC charge stocks from the distillation of crude oils contain significant amounts (greater than 1.0 ppm) of heavy metals. They may also contain significant amounts (greater than 1.0 ppm) of alkaline metals, such as sodium, magnesium and calcium. Residual fractions from crude oil distillation have even greater amounts of heavy metals and alkaline metals and may also have high Conradson carbon values. The invention is particularly useful in the pretreatment of such residual fractions to provide carbometallic oil feeds for RCC units.

It is to be understood that the catalyst particles can be of any size, depending on the size appropriate to the upgrading process in which the sorbent is to be employed. Thus, while a fluidizable size is preferred, larger particles of the select sorbent may be employed, such as in a moving bed for upgrading unvaporized feeds. If the used catalyst is too large for the sorbent process selected, it may be ground up or otherwise comminuted to provide a sorbent of the desired particle size.

The problems of the prior art caused by vanadium containing feedstocks are overcome by employing the select sorbent of this invention. This invention is especially effective in the treatment of reduced crudes and other carbo-metallic feeds with high metals, high vanadium to nickel ratios and high Conradson carbon values. Such MRS (Metals Removal System) feeds with high metal and Conradson carbon values are preferably contacted in a riser with the inert solid sorbent of increased pore volume and very low catalytic cracking activity at temperatures above about 900° F. Residence time of the oil in the riser is below 5 seconds, preferably below 3 seconds and most preferably in the range of 0.5 to 2 seconds. The preferred sorbent is a spray dried catalyst composition in the form of microspherical particles generally in the size range of 10 to 200 microns, preferably 20 to 150 microns and more preferably between 40 and 80 microns, to ensure adequate fluidization properties. These particles preferably are comprised of recovered microspheres of equilibrium catalysts from FCC and/or RCC conversion operations.

The MRS feed is introduced at the bottom of the riser and contacts the sorbent at a temperature of 1,150°–1,400° F. to yield a temperature at the exit of the riser in the sorbent disengagement vessel of approximately 900°–1,000° F. Along with the MRS feed, water, steam, naphtha, flue gas, or other vapors or gases may be introduced to aid in vaporization of the feed and act as a lift gas for providing the short residence time desired.

Coked sorbent is abruptly separated from the hydrocarbon vapors at the exit of the riser by a ballistic separation apparatus employing the vented riser concept developed by Ashland Oil, Inc., and described in U.S. Pat. Nos. 4,066,533 and 4,070,159 to Myers, et al., which patents are incorporated herein by reference.

During the course of the treatment in the riser, the metal and Conradson carbon compounds are deposited on the sorbent. After ballistic separation from the product vapors, the coked sorbent is deposited as a dense but fluffed bed at the bottom of the disengagement vessel, transferred to a stripper and then to a regeneration zone in a "combustor" vessel. In the combustor, the coked sorbent is contacted with an oxygen containing gas to remove the coke deposits by combustion of this carbonaceous material to form carbon oxides and yield a regenerated sorbent containing less than 0.5 wt% carbon based on weight of sorbent, preferably less than 0.2 wt% carbon and more preferably less than 0.10 wt% carbon. The regenerated sorbent is then recycled to the bottom of the riser where it again joins high metal and Conradson carbon containing feed to repeat the cycle.

At the elevated temperatures encountered in the regeneration zone, the vanadium deposited on the sorbent in the riser is converted to vanadium oxides, in particular, vanadium pentoxide. The melting point of vanadium pentoxide is much lower than the temperatures encountered in the regeneration zone. Thus, it can become a mobile liquid and flow across the sorbent surface so as to cause pore plugging and particle coalescence, which phenomena are particularly prevalent with sorbents of the type described in the literature.

This application describes a new approach to offsetting the adverse effects of vanadium pentoxide by employing high surface area, high pore volume catalytic materials whose catalytic cracking activity has been neutralized by the incorporation of one or more alkaline metals or their oxides, salts or other compounds. This alkaline metal additive may be introduced into the catalytic matererial by conventional impregnation techniques, or during the upgrading of a carbo-metallic oil by introducing the additive at one or more select points in the upgrading system to affect neutralization of the active catalytic cracking sites.

The preferred alkaline metal additives for neutralizing the acidic cracking sites include the following metals, their oxides, salts, and/or organo-metallic compounds: Li, Na, K, Rb, Cs, Mg, Ca, Sr, and Ba. Other additives which may be used include the other elements of Groups IA and IIA of the Periodic Chart of Elements and their compounds. These alkaline metal additives may be impregnated on the catalyst in amounts sufficient to yield a concentration of the alkaline metal element on the sorbent in the range of about 0.1 to 10 percent, more preferably about 0.2 to 5 percent and most preferably about 0.5 to 2 percent by weight. As an alternative, the amount of additive metal used may be based on its neutralization equivalency and the concentration of residual acidic sites on the catalyst that are to be neutralized as explained in more detail below. If added instead during the treatment process, the metal elements may build up to these concentrations on equilibrium sorbent and be maintained at these levels by controlling the rate of additive addition relative to the rate of sorbent replacement.

The sorbents of this invention are prepared from solids of high activity, such as deactivated, spent and/or equilibrium catalysts withdrawn from FCC and/or RCC processing operations. The catalysts withdrawn from FCC or RCC operations contain catalytically active aluminosilicate zeolite in a matrix which may itself posses significant cracking activity or have no significant cracking activity, e.g., kaolin. The catalytically active cracking sites present in the matrix and in the aluminosilicate zeolite are neutralized by the select alkaline metal additives previously described to yield a sorbent possessing extremely low or essentially no catalytic activity and high adsorptive powers for liquid vanadia. These sorbents preferably have a surface area above about 20 $m^2/g$, more preferably above about 50 $m^2/g$ and most preferably above about 70 $m^2/g$; a pore volume greater than about 0.2 cc/g, more preferably greater than about 0.3 cc/gm and most preferably greater than about 0.4 cc/gm; and a microactivity value, as measured by ASTM Test Method No. D3907-80 and reported as MAT relative activity where relative activity of the standard is 100%, of below about 1%, more preferably below about 0.6%, still more preferably in the range of about 0 to 0.2% and most preferably below about 0.05%. These relative activities correspond approximately to respective MAT values in volume percent conversion of below about 35%, more preferably below about 30%, still more preferably in the range of about 0 to about 20% and most preferably below about 7.0%.

The select sorbents and the upgrading processes described herein are preferably employed to provide an RCC feedstock for the carbo-metallic oil conversion (RCC) processes described more fully below and in the copending patent applications referenced below (all pending patent applications referred to in this specification are assigned or are to be assigned to Ashland Oil, Inc.). Although the term "RCC" is an abbreviation derived from a heavy oil conversion process known as Reduced Crude Conversion, this term is employed herein to refer generally to those processes for cracking and/or reforming oil feeds having levels of heavy metals, alkaline metals and/or Conradson carbon generally higher than those usually employed in Fluid Catalytic Cracking (FCC) operations. The term "MRS" is employed herein to refer generally to those processes for upgrading a poor grade of feedstock oil by contacting this oil with a sorbent material. The invention further contemplates combined MRS and RCC processes wherein feedstock for the RCC process is comprised of an upgraded liquid product from the MRS process and the sorbent for the MRS process is comprised of an RCC equilibrium catalyst wthdrawn from the RCC process and treated with the select alkaline metal additives of the invention. Similarly, the invention contemplates combined MRS and FCC processes wherein feedstock for the FCC process is comprised of an upgraded liquid product from the MRS process and the sorbent for the MRS process is comprised of an FCC equilibrium catalyst withdrawn from the FCC process and treated with select alkaline metal additives of the invention. It is also contemplated that the MRS sorbent may be comprised of combinations of RCC and/or FCC catalysts from partially or wholly integrated conversion operations and/or from entirely independent conversion operations, and that one fraction of the MRS product may be used as an RCC feedstock while another fraction is being used simultaneously as an FCC feedstock.

BRIEF DESCRIPTION OF THE DRAWINGS

The invention may be further understood by reference to the description of the best and other illustrative modes for carrying out the invention taken in conjunction with the accompanying drawings in which.

BEST AND OTHER ILLUSTRATIVE MODES FOR CARRYING OUT THE INVENTION

Figure 1:
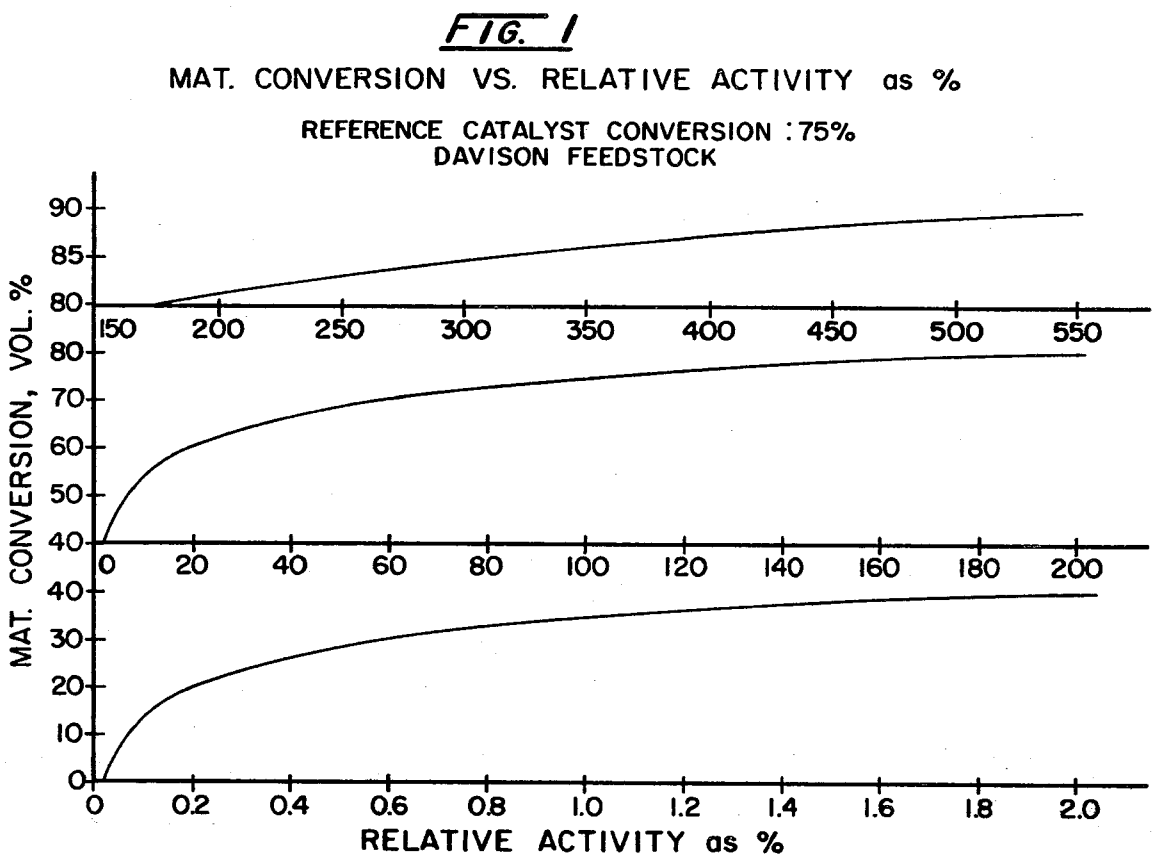
FIG. 1 is a graph illustrating the numerical relationship between MAT relative activity and MAT volume percent conversion.

A catalytically active cracking catalyst containing zeolite as a promoter is first manufactured and then utilized in an FCC or RCC process over a period of time to yield a less active or "used" equilibrium catalyst. Thereafter, the residual active cracking sites of the used catalyst are neutralized with an alkaline metal additive to yield the select sorbent of this invention and the select sorbent is employed to upgrade a metals and Conradson carbon containing oil for use as feed in the same or a different FCC or RCC process.

The catalytic material, which preferably is but need not be a deactivated, spent or equilibrium catalyst from an FCC or RCC process, is treated with a sufficient amount of the alkaline metal additive to neutralize substantially all of the acidic catalytic cracking sites and yield a sorbent with a micro-activity test (MAT) value of preferably less than about 30 volume percent, more preferably less than about 20 volume percent, still more preferably less than about 10 volume percent and most preferably about 8 volume percent or less as measured by ASTM Test Method No. D3907-80. Thorough neutralization of the acid catalytic cracking sites avoids significant cracking activity in the MRS upgrading process and maximizes the yield of high quality liquid product available for use as feed in a subsequent FCC or RCC conversion operation employing a highly selective cracking catalyst under optimum cracking conditions. This optimized upgrading followed by optimized conversion substantially increases the overall yields of high octane liquid fuels from poor grades of crude or resid containing oils.

It is not proposed to define the exact mechanism by which the sorbent of this invention reduces the adverse effects of vanadia deposits accumulating on the sorbent material. However, the sorbent of this invention enjoys a higher surface area and pore volume than that exhibited or possessed by conventional sorbents described in the literature. Without intending to be bound by any one theory or hypothesis, it is believed that this increased surface area and pore volume permits large amounts of vanadia to be adsorbed within the pore structure before vanadia can accumulate on exterior particle surfaces in amounts sufficient to cause pore plugging and/or particle coalescence. The invention contemplates the lower oxidation states of vanadium as well as vanadium pentoxide. Furthermore, in treating a sulfur containing feed and regenerating sorbent in the presence of an oxygen containing gas, the vanadium may also be present as a sulfide, sulfate and/or oxysulfide. The methods of making and using the select sorbents of the invention are described fully in the following sections of this specification.

CATALYST COMPOSITIONS

The select MRS sorbents of this invention are prepared from solids having some catalytic activity such as zeolites in a matrix of clays, kaolin, silica, alumina, smectites and other 2-layered lamellar silicates, silica-alumina, or a combination of two or more of these matrix materials. The surface area of these sorbents are preferably above 50 $m^2/g$ and preferably they have a pore volume substantially in excess of 0.2 cc/g.

A preferred matrix material for catalyst compositions to be used ultimately as a MRS sorbent is a semi-synthetic combination of clay and silica-alumina as described in U.S. Pat. No. 3,034,994, the entire disclosure of which is incorporated herein by reference. Preferably the clay is mostly a kaolinite and is combined with a synthetic silica-alumina hydrogel or hydrosol. This synthetic component forms preferably about 15 to 75 percent, more preferably about 20 to 25 percent, of the final catalyst composition by weight. The proportion of clay is such that the catalyst preferably contains after forming, about 10 to 75 percent, more preferably about 30 to 50 percent, clay based on total weight of catalyst, including zeolite and/or other promoters. The most preferred composition of the matrix contains approximately twice as much clay as synthetically derived silica-alumina. The synthetically derived silica-alumina may contain 55 to 95 percent by weight of silica ($SiO_2$), preferably 65 to 85 percent, most preferably about 75 percent. Catalysts wherein the gel matrix consists entirely of silica gel or alumina gel are also included.

Various processes may be used in preparing the synthetic silica-alumina matrix, such as those described in U.S. Pat. No. 3,034,994. A preferred one of these processes involves gelling an alkali metal silicate with an inorganic acid while maintaining the pH on the alkaline side. An aqueous solution of an acidic aluminum salt is then intimately mixed with the silica hydrogel so that the aluminum salt solution fills the silica hydrogel pores. The aluminum is thereafter precipitated as a hydrous alumina by the addition of an alkaline compound, the hydrous alumina combining with silica at the surface of the silica hydrogen pores. The hydrous gel is then processed, for instance, by separating a part of the water on vacuum filters and then drying, or more preferably, by spray drying the hydrous gel slurry to produce microspheres. The dried product is washed to remove sodium and sulfate ions, either with water or a very weak acid solution. The resulting product is then dried to a low moisture content, usually less than 25 percent by weight, e.g., 10 percent to 20 percent by weight, to provide a finished catalyst product.

The silica-alumina hydrogel slurry may be filtered and washed in gel form to affect purification of the gel by the removal of dissolved salts. This may enhance the formation of a continuous phase in the spray dried microspherical particles. If the slurry is prefiltered and washed and it is desired to spray dry the filter cake, the latter may be reslurried with enough water to produce a pumpable mixture for spray drying. The spray dried product may then be washed again and given a final drying in the manner previously described.

Prior to final drying of the matrix material, it is preferably mixed with a highly active catalytic promoter, such as a zeolite. The zeolite component is preferably a synthetic faujasite which possesses silica to alumina ratios in the range from about 2.5 to 7.0, preferably 3.0 to 6.0 and most preferably 4.5 to 6.0. Synthetic faujasites are widely known crystalline aluminosilicate zeolites and common examples are the x and Y types of zeolites commercially available from the Davison Division of W. R. Grace and Company and the Linde Division of Union Carbide Corporation. The ultra-stable hydrogen exchanged zeolites, such as Z-14XS and Z-14US from Davison, are also particularly suitable. In addition to faujasites, other preferred types of zeolitic materials are mordenite and erionite.

The most commonly used Y-type faujasites may be prepared as described in U.S. Pat. Nos. 3,130,007 and 4,010,116, the entire disclosures of which are incorporated herein by reference. The aluminosilicates of the latter patent have high silica ($SiO_2$) to alumina ($Al_2O_3$) molar ratios, preferably above 4, to give high thermal stability.

Zeolites used for catalytic cracking are usually made in the sodium form and then exchanged with polyvalent cations to reduce the $Na_2O$ content to less than about 1.0 percent by weight, and preferably less than 0.1 percent by weight. Procedures for removing alkali metals and putting zeolites in the proper form are well-known in the art and are described, for example, in U.S. Pat. Nos. 3,293,192; 3,402,996; 3,446,727; 3,449,070; and 3,537,816; the entire disclosures of said patents being incorporated herein by reference.

The amount of zeolitic material dispersed in the matrix material based on the final composite product should be at least about 5 weight percent, preferably in the range of about 10 to 50 weight percent, most preferably about 20 to 40 weight percent.

Crystalline aluminosilicate zeolites exhibit acidic sites on both interior and exterior surfaces, with the largest proportion of total surface area and cracking sites being located internal to the zeolite crystals within crystalline micropores. Zeolites are usually crystallized as regularly shaped discrete particles of approximately 0.1 to 10 microns in size and, accordingly, this is the size range normally provided by commercial catalyst suppliers. The particle size of the zeolites are preferably in the lower portion of this size range in order to increase exterior (portal) surface areas. The preferred zeolites are thermally stabilized with hydrogen and/or rare earth ions and are steam stable to about 1,650° F.

The zeolites can be suitably dispersed in the matrix materials for use as cracking catalysts by methods well-known in the art, such as those disclosed, for example, in U.S. Pat. Nos. 3,140,249 and 3,140,253 to Plank, et al.; U.S. Pat. No. 3,660,274 to Blazek, et al.; U.S. Pat. No. 4,010,116 to Secor, et al.; U.S. Pat. No. 3,944,482 to Mitchell, et al.; and U.S. Pat. No. 4,079,019 to Scherzer, et al.; the entire disclosures of said patents being incorporated herein by reference.

After introduction of the zeolite, the composition is preferably slurried and spray dried to form microspheres of matrix material having zeolite particles (crystals) dispersed uniformly therein. As an alternative to intimately mixing a preformed zeolite with a slurried matrix material, the zeolite may be formed in situ by silication of a clay component of the matrix as described in U.S. Pat. No. 4,010,116. The finished catalyst should contain from 5 to 50% by weight zeolite, preferably a rare earth or ammonia exchanged sieve of either or both the X and Y variety. To further enhance catalyst hydrothermal stability, the spray dried microspheres containing a previously exchanged sieve are preferably calcined and further exchanged with rare earth or ammonia to create an exceptionally stable sieve.

Commercial zeolite-containing catalysts are available with carriers containing a variety of metal oxides and combination thereof, including for example silica, alumina, magnesia and mixtures thereof, and mixtures of such oxides with clays as described, for example, in U.S. Pat. No. 3,034,948, the entire disclosure of which is incorporated herein by reference. One may for example select any of the zeolite-containing FCC catalysts which are suitable for production of gasoline from vacuum gas oils. However, certain advantages may be attained by judicious selection of catalysts having marked resistance to metals, e.g., RCC molecular sieve catalysts. A metal resistant zeolite catalyst is, for instance, described in U.S. Pat. No. 3,944,482, which catalyst contains 1 to 40 weight percent of a rare earth-exchanged zeolite, the balance being a refractory metal oxide matrix having a specified pore volume and size distribution. Other catalysts described as "metals-tolerant" are disclosed in an article by Cimbalo, et al., entitled "Deposited Metals Poison FCC Catalysts", *Oil and Gas Journal*, May 15, 1972, pp. 112–122, the entire contents of which are incorporated herein by reference.

In progressive flow FCC and RCC reactors and/or in progressive flow MRS contactors, it is preferred to employ solids having an overall particle size in the range of about 10 to about 200 microns, more preferably about 20 to 150 microns and most preferably about 40 to about 80 microns. A useful catalyst sorbent may have a skeletal density of about 150 pounds per cubic foot and an average particle size of about 60–70 microns, with less than 10% of the particles having a size less than about 40 microns and less than 80% having a size less than about 50–60 microns.

Although a wide variety of other catalysts, including both zeolite-containing and non-zeolite-containing, may be employed in the practice of the invention, the following are examples of commercially available catalysts which may be employed in practicing the invention:

TABLE 1

| | Specific Surface $m^2/g$ | Weight Percent | | | | | |
|---|---|---|---|---|---|---|---|
| | | Zeolite Content | $Al_2O_3$ | $SiO_2$ | $Na_2O$ | $Fe_2O$ | $TiO_2$ |
| AGZ-290 | 300 | 11.0 | 29.5 | 59.0 | 0.40 | 0.11 | 0.59 |
| GRZ-1 | 162 | 14.0 | 23.4 | 69.0 | 0.10 | 0.4 | 0.9 |
| CCZ-220 | 129 | 11.0 | 34.6 | 60.0 | 0.60 | 0.57 | 1.9 |
| Super DX | 155 | 13.0 | 31.0 | 65.0 | 0.80 | 0.57 | 1.6 |
| F-87 | 240 | 10.0 | 44.0 | 50.0 | 0.80 | 0.70 | 1.6 |
| FOX-90 | 240 | 8.0 | 44.0 | 52.0 | 0.65 | 0.65 | 1.1 |
| HFZ-20 | 310 | 20.0 | 59.0 | 40.0 | 0.47 | 0.54 | 2.75 |
| HEZ-55 | 210 | 19.0 | 59.0 | 35.2 | 0.60 | 0.60 | 2.5 |

The AGZ-290, GRZ-1, CCZ-220 and Super DX catalysts referred to above are products of W. R. Grace and Company. F-87 and FOX-90 are products of Filtrol, while HFZ-20 and HEZ-55 are products of Engelhard/Houdry. The above are properties of virgin catalyst and, except in the case of zeolite content, are adjusted to a water-free basis, i.e., based on material ignited at 1,750° F. The zeolite content is derived by comparison of the X-ray intensities of a catalyst sample and of a standard material composed of high purity sodium Y zeolite in accordance with draft #6, dated Jan. 9, 1978, of proposed ASTM Standard Method entitled "Determination of the Faujasite Content of a Catalyst".

Among the above-mentioned commercially available catalysts, the Super D family and especially a catalyst designated GRZ-1 are particularly preferred. For example, Super DX has given particularly good results with relatively high metals. The GRZ-1, although substantially more expensive than the Super DX at present, appears somewhat more metals-tolerant.

Although not yet commercially available, it is believed that the best catalysts for carrying out the present invention are those which are characterized by matrices with feeder pores having large minimum diameters and large mouths to facilitate diffusion of high molecular weight molecules through the matrix to the portal surface area of molecular sieve particles within the matrix. Such matrices preferably also have a relatively large pore volume in order to soak up unvaporized portions of a carbo-metallic oil feed. Thus, significant numbers of liquid hydrocarbon molecules can diffuse to active catalytic sites both in the matrix and in sieve particles at the surface of the matrix. In general it is preferred to employ catalysts having a total pore volume greater than 0.2 cc/gm, preferably at least 0.4 cc/gm, more preferably at least 0.6 cc/gm and most preferably in the range of 0.7 to 1.0 cc/gm, and with matrices wherein at least 0.1 cc/gm, and preferably at least 0.2 cc/gm, of said total pore volume is comprised of feeder pores having diameters in the range of about 400 to about 6,000 angstrom units, more preferably in the range of about 1,000 to about 6,000 angstrom units. These catalysts and the method for making the same are described more fully in copending international application Ser. No. PCT/US81/00492 filed in the U.S. Receiving Office on Apr. 10, 1981, in the names of Ashland Oil, Inc., et al., and entitled "Large Pore Catalysts for Heavy Hydrocarbon Conversion", the entire disclosure of said application being incorporated herein by reference.

The catalyst composition to be used as sorbent may include various additives for passivating the non-selective catalytic activity of heavy metal deposits on the conversion catalyst. The catalyst may be impregnated with these additives during manufacture and/or the additives may be introduced into the riser, the regenerator or other conversion system components during the FCC or RCC conversion process in which the catalyst is initially employed. Preferred additives for this purpose includes those disclosed in U.S. patent application Ser. No. 263,395, filed on May 13, 1981, in the name of William P. Hettinger, Jr., and entitled "Passivating Heavy Metals in Carbo-Metallic Oil Conversion", the entire disclosure of said U.S. application being incorporated herein by reference.

Other metal additives specifically for reducing the adverse effects of vanadium on catalyst may be employed as described in PCT International Application Ser. No. PCT/US81/00356 filed in the U.S. Receiving Office on Mar. 19, 1981, in the names of Ashland Oil, Inc., et al., and entitled "Immobilization of Vanadia Deposited on Catalytic Materials During Carbo-Metallic Oil Conversion", the entire disclosure of said PCT International Application being incorporated herein by reference. The catalyst composition may further include special ingredients for trapping vanadium within the porous matrix of the particles as described in U.S. patent application Ser. No. 252,967 filed on Apr. 10, 1981, in the names of James D. Carruthers, et al., and entitled "Trapping of Metals Deposited on Catalytic Materials During Carbo-Metallic Oil Conversion", the entire disclosure of which is incorporated herein by reference.

PREPARATION OF SORBENT

Prior to inclusion of one or more of the alkaline metal additives of the present invention into a catalyst of the foregoing type, the catalyst is preferably used in a FCC conversion operation of the progressive flow type or in one of Ashland's RCC conversion operations. In such operations, the appropriate FCC or RCC feed is introduced into the bottom of a riser reactor of the type illustrated in FIG. 5 along with a heated suspension of the catalyst. Steam, naphtha, water, flue gas and/or some other diluent is preferably also introduced into the riser to aid in dispersing and mixing the feed and catalyst and as a source of vapor for accelerating the feed and catalyst to achieve the vapor velocities and residence times desired. As the feed travels up the riser, it is catalytically cracked to form basically five products known in the industry as dry gas, wet gas, cat naphtha, light cycle oil, heavy cycle oil and/or slurry oil. At the upper end of the riser, the catalyst particles are ballistically separated from product vapors using the vented riser techniques described elsewhere in this specification. The catalyst, which then contains the coke and heavy metal deposits formed in the riser, is sent to the regenerator to burn off the coke and the separated product vapors are sent to a fractionator for further separation and treatment to provide the five basic products indicated.

The preferred riser conditions of an FCC process providing a source of equilibrium FCC catalyst for practicing the invention are summarized in Table 2. The preferred riser conditions of Ashland's RCC processes providing a source of equilibrium RCC catalyst for practicing the invention are summarized in Table 3. In these tables, the abbreviations used have the following meanings: "Temp." for temperature, "Dil." for diluent, "pp" for partial pressure, "wgt" for weight, "V" for vapor, "Res." for residence, "C/O" for catalyst to oil ratio, "Cat." for catalyst, "bbl" for barrel, "MAT" for micro-activity by the MAT test using a standard Davison feedstock, "Vel." for velocity, "cge" for charge, "d" for density and "Reg." for regenerated.

TABLE 2

FCC RISER CONDITIONS

| Parameter | Board Operating Range | Preferred Range |
|---|---|---|
| Feed Temp. | 400-800° F. | 400-650° F. |
| Steam Temp. | 200-500° F. | 300-400° F. |
| Reg. Catalyst Temp. | 1000-1400° F. | 1175-1350° F. |
| Riser Exit Temp. | 900-1200° F. | 925-1050° F. |
| Pressure | 0-100 psia | 10-50 psia |
| Water/Feed | 0.01-0.15 | 0.01-0.10 |
| Dil. pp/Feed pp | 0.15-2.0 | 0.25-1.0 |
| Dil. wgt/Feed wgt | ≦0.2 | 0.01-0.1 |
| V. Res. Time | 0.1-5 sec. | 0.5-3 sec. |
| C/O, wgt. | 4-12 | 5-10 |
| Lbs. Cat./bbl Feed | 0.01-2.0 | 0.05-1 |
| Inlet Cat. MAT | >60 vol. % | 70-85 vol. % |
| Outlet Cat. MAT | ≧55 vol. % | ≧65 vol. % |
| V. Vel. | 25-90 ft./sec. | 30-60 ft./sec. |
| V. Vel./Cat. Vel. | ≧1.0 | 1.2-2.0 |
| Dil. Cge. Vel. | 5-90 ft./sec. | 10-50 ft./sec. |
| Oil Cge. Vel. | 1-50 ft./sec. | 5-50 ft./sec. |
| Inlet cat. d. | 1-9 lbs./ft.$^3$ | 2-6 lbs./ft.$^3$ |
| Outlet cat. d. | 1-6 lbs./ft.$^3$ | 1-3 lbs./ft.$^3$ |

TABLE 3

RCC RISER CONDITIONS

| Parameter | Board Operating Range | Preferred Range |
|---|---|---|
| Feed Temp. | 400-800° F. | 400-650° F. |
| Steam Temp. | 200-500° F. | 300-400° F. |
| Reg. Catalyst Temp. | 1100-1500° F. | 1275-1450° F. |
| Riser Exit Temp. | 900-1400° F. | 950-1100° F. |
| Pressure | 0-100 psia | 10-50 psia |
| Water/Feed | 0.05-0.30 | 0.05-0.15 |
| Dil. pp/Feed pp | 0.25-3.0 | 1.0-2.5 |
| Dil. wgt/Feed wgt | ≦0.4 | 0.1-0.3 |
| V. Res. Time | 0.1-5 sec. | 0.5-3 sec. |
| C/O, wgt. | 3-18 | 5-12 |
| Lbs. Cat./bbl Feed | 0.1-4.0 | 0.2-2.0 |
| Inlet Cat. MAT | >50 vol. % | ≧60 vol. % |
| Outlet Cat. MAT | ≧20 vol. % | ≧40 vol. % |
| V. Vel. | ≧25 ft./sec. | ≧30 ft./sec. |
| V. Vel./Cat. Vel. | ≧1.0 | 1.2-2.0 |
| Dil. Cge. Vel. | 5-90 ft./sec. | 10-50 ft./sec. |
| Oil Cge. Vel. | 1-50 ft./sec. | 5-50 ft./sec. |
| Inlet cat. d. | 1-9 lbs./ft.$^3$ | 2-6 lbs/ft.$^3$ |
| Outlet cat. d. | 1-6 lbs./ft.$^3$ | 1-3 lbs/ft.$^3$ |

The gas for burning coke off of the catalyst in the regenerator may be any gas which can provide oxygen to convert carbon to carbon oxides. Air is highly suitable for this purpose in view of its ready availability. The amount of air required per pound of coke for combustion depends upon the desired carbon dioxide to carbon monoxide ratio in the effluent gases and upon the amount of other combustible materials present in the coke, such as hydrogen, sulfur, nitrogen and other elements capable of forming gaseous oxides at regenerator conditions. Following coke burnoff, the regenerated catalyst is recycled to the riser for contact with fresh feed.

At such time that the metal level on the catalyst becomes intolerably high such that catalyst activity and/or selectivity declines to unacceptable levels, virgin catalyst is added and deactivated equilibrium catalyst is withdrawn at one or more addition-withdrawal locations in the conversion/regeneration cycle. Equilibrium catalyst is preferably withdrawn from the FCC or RCC process when its MAT cracking activity has decreased to a value less than about 60 volume percent, more preferably less than about 55 volume percent, which values correspond to MAT relative activities of about 20 percent and 10 percent, respectively.

The withdrawn catalyst is then treated with the select alkaline metal salts described below to neutralize residual acid cracking sites and yield a material with essentially no catalytic cracking activity. The method of addition of the alkaline metal additives to the used FCC or RCC catalyst can be by addition during the upgrading MRS process cycle of by impregnation of the catalyst particles prior to use in the MRS process cycle.

The additive alkaline metals of the invention include the metal elements of Groups IA and IIA of the Periodic Chart Of The Elements. The invention also contemplates treatment of the catalyst with other additive metals that possess alkaline or amphoteric properties, such as zinc and cadmium in Group IIB, gallium and indium in Group IIIA, germanium and tin in Group IVA and arsenic, antimony and bismuth in Group VA. The preferred alkaline metals are Li, Na, K, Rb, Cs, Mg, Ca, Sr and Ba. The more preferred alkaline metal additives are compounds of sodium, potassium, magnesium, calcium or barium or a mixture of the compounds of these metals.

Where the metal additive is introduced directly into the upgrading process, that is into the riser, into the regenerator or into an intermediate component, the alkaline metal additives are preferably organo-metallic compounds soluble in the hydrocarbon feed or in a hydrocarbon solvent miscible with the feed, or are water soluble salts of sufficient solubility for the quantities required to be added to water streams fed to the upgrading process. Various inorganic compounds are also soluble in hydrocarbon solvents. The invention therefore is not limied to the examples given.

The organo-metallic additives would include alcoholates, esters, phenolates, naphthenates, carboxylates, dienyl sandwich compounds. The organo-metallic additives are preferably introduced directly into the hydrocarbon upgrading zone, preferably near the bottom of the riser, so that the alkaline metal additive will be deposited on the sorbent. When the alkaline metal of the invention reaches the regenerator, its oxide is formed either by decomposition of the additive directly to the metal oxide or by decomposition of the additive to the free metal which is then oxidized under the regenerator conditions. This provides intimate contact between the alkaline metal additive and the acidic cracking sites and is believed to be an effective means for neutralizing the acidic cracking sites present in the matrix and zeolite structures.

The alkaline metal additive is introduced into the riser by mixing it with the feed in an amount sufficient to give at least about a 1:1 ratio, preferably a ratio in the range of about 1.2 to about 2.0, of alkaline neutralization equivalents to acid sites still remaining on the partially deactivated catalyst (alkaline newutralization ratio), the neutralization equivalency of an alkaline metal being depending upon its valence in the additive compound. For example, sodium has a neutralization equivalency of 1 and magnesium has a neutralization equivalency of 2. Therefore, a 1:1 alkaline neutralization ratio for a given number of acid sites requires an equal number of sodium atoms but only one-half that number of magnesium atoms. A 1:1 alkaline neutralization ratio for alkaline metals having valences greater than 1 assumes that the acidic sites are close enough together for a single metal atom to neutralize multiple acidic sites. Since this assumption may not hold near the end of neutralization where residual acidic sites may occur at significant intervals apart, alkaline neutralization ratios toward the upper end of the specified range of 1.2 to 2.0 are preferred for alkaline metals having valence states greater than 1.

The residual acidity of withdrawn FCC or RCC equilibrium catalyst may be determined by techniques well known in the art such as, for example, by titration with a standard basic solution of known volume and strength. One such technique is described in an article entitled "Technique for Measuring Surface Acidity of Catalyst", by H. A. Benesi in the *Journal of Physical Chemistry,* Vol. 61, page 970, 1957, and involves titration of the catalyst with n-butyl amine in a non-aqueous solvent such as benzene. Other techniques for determining the number of acid sites per weight of catalyst are described in a multi-volume treatise entitled *Advances in Catalysis,* 1978, in the section by H. A. Benesi commencing at page 97 of vol. 27. The entire disclosures of said article and section by H. A. Benesi are incorporated herein by reference.

If the alkaline metal additive is added directly to the deactivated, spent or equilibrium catalyst at some time before the sorbent is introduced into the upgrading system, the alkaline metal additive is preferably a water soluble organic and/or inorganic salt of the specified metals, such as the acetate, halide, nitrate, sulfate, sulfite and/or carbonate. These water soluble alkaline metal additives may also be introduced into the treatment process along with water containing streams, such as used to cool the regenerator or to lift, fluidize or strip the sorbent.

After neutralization of the catalytic acid sites, the select sorbents of the invention have a micro-activity (MAT) value in volume percent conversion as measured by ASTM Test Method No. D-3907-80 preferably below about 35%, more preferably below about 20%, still more preferably below about 10% and most preferably in the range of about 0% to about 7%. In general, it is preferred to employ a sorbent having essentially no cracking activity so as to provide very low levels of conversion at low residence times. Catalytic cracking activity is preferably minimized during the upgrading process to provide the maximum amount of a high quality liquid feed which is low in contaminates and can therefore be cracked later either in a downstream conversion zone or in a separate conversion process operated at optimum conditions for selective catalytic cracking. Catalytic cracking during the upgrading process, which necessarily takes place in the presence of relatively high levels of contaminates, is much more non-selective and produces both lower octane products and higher yields of coke and light gases than catalytic cracking of better quality feed in the absence of such adverse contaminate levels.

The cracking capabilities of the sorbent may be expressed in terms of the conversion produced during actual operation of the process and/or in terms of conversion produced in standard catalyst activity tests. For example, the preferred sorbent may be defined as a catalyst which, in its neutralized state, exhibits a specified activity expressed as a percentage in terms of MAT (microactivity test) conversion. For purposes of the present invention, the foregoing percentage is the volume percentage of standard feedstock which the sorbent under evaluation will convert to 430° F. end point gasoline, lighter products and coke at 900° F., 16 WHSV (weight hourly space velocity calculated on a moisture free basis using clean catalyst which has been dried at 1100° F., weighed and then conditioned for a period of at least 8 hours at about 25° C. and 50% relative humidity, until about one hour or less prior to contacting the feed), and 3 S/O (sorbent to oil weight ratio) by ASTM D-32 MAT test D-3907-80. The standard feedstock is an appropriate high grade petroleum oil, e.g., a sweet light primary gas oil, such as that used by the Davison Division of W. R. Grace and defined as follows:

| | |
|---|---|
| API Gravity at 60° F., degrees | 31.9 |
| Specific Gravity at 60° F., g/cc | 0.8708 |
| Ramsbottom Carbon, wt. % | 0.09 |
| Conradson carbon, wt. % (est.) | 0.04 |
| Carbon, wt. % | 84.92 |
| Hydrogen, wt. % | 12.94 |
| Sulfur, wt. % | 0.68 |
| Nitrogen, ppm | 305 |
| Viscosity at 100° F., centistokes | 10.36 |
| Watson K Factor | 11.93 |
| Aniline Point | 182 |
| Bromine No. | 2.2 |
| Paraffins, Vol. % | 31.7 |
| Olefins, Vol. % | 1.8 |
| Naphthenes, Vol. % | 44.0 |
| Aromatics, Vol. % | 22.0 |
| Average Molecular Weight | 284 |
| Nickel | Trace |
| Vanadium | Trace |
| Iron | Trace |
| Sodium | Trace |
| Chlorides | Trace |
| B S & W | Trace |
| Distillation | ASTM D-1160 |
| IBP | 445 |
| 10% | 601 |
| 30% | 664 |
| 50% | 701 |
| 70% | 734 |
| 90% | 787 |
| FBP | 834 |

The gasoline end point and boiling temperature-volume percent relationships of the products produced in the MAT conversion test may for example be determined by simulated distillation techniques, for example by modification of the gas chromatographic "Sim-D" technique of ASTM D-2887-73. The results of such simulations are in reasonable agreement with the results obtained by subjecting larger samples of material to standard laboratory distillation techniques. Conversion is calculated by subtracting from 100 the volume percent (based on fresh feed) of those products heavier than gasoline which remain in the recovered product.

On pages 935–937 of Hougen and Watson, "Chemical Process Principles", John Wiley & Sons, Inc., N.Y. (1947), the concept of "Activity Factors" is discussed. This concept leads to the use of "relative activity" to compare the cracking activity of an operating sorbent against a standard material (catalyst). Relative activity measurements facilitate recognition of how the quantity requirements of various materials differ from one another. Thus, relative activity is a ratio obtained by dividing the weight of a standard or reference material (catalyst) which is or would be required to produce a given level of conversion by the weight of an operating material (whether proposed or actually used) which is or would be required to produce the same level of conversion using the same or equivalent feedstock under the same or equivalent conditions. Said ratio of material weights may be expressed as a numerical ratio, but preferably is converted to a percentage basis. The standard material is preferably chosen from among catalyst, such as for example, zeolite fluid cracking catalysts, and is chosen for its ability to produce a predetermined level of conversion using a standard feed under the conditions of temperature, WHSV, catalyst to oil ratio and other conditions set forth in the preceding description of the MAT conversion test and in ASTM D-32 MAT test D-3907-80. Conversion is the volume percentage of feedstock that is converted to 430° F. endpoint gasoline, lighter products and coke. For standard feed, one may employ the above-mentioned light primary gas oil, or equivalent.

For purposes of conducting relative activity determinations, one may prepare a "standard catalyst curve", a chart or graph of conversion (as above defined) vs. reciprocal WHSV for the standard catalyst and feedstock. A sufficient number of runs is made under ASTM D-3907-80 conditions (as modified above) using standard feedstock at varying levels of WHSV to prepare an accurate "curve" of conversion vs. WHSV for the standard feedstock. This curve should traverse all or substantially all of the various levels of conversion, including the range of conversion within which it is expected that the operating sorbent will be tested. From this curve, one may establish a standard WHSV for test comparisons and a standard value of reciprocal WHSV corresponding to that level of conversion which has been chosen to represent 100% relative activity in the standard catalyst. For purposes of the present disclosure, the aforementioned reciprocal WHSV and level of conversion are, respectively, 0.0625 and 75%. In testing an operating sorbent of unknown relative activity, one conducts a sufficient number of runs with that sorbent under D-3907-80 conditions (as modified above) to establish the level of conversion which is or would be produced with the operating sorbent at standard reciprocal WHSV.

Then, using the above-mentioned standard catalyst curve, one establishes a hypothetical reciprocal WHSV constituting the reciprocal WHSV which would have been required, using the standard catalyst, to obtain the same level of conversion which was or would be exhibited by the operating sorbent at standard WHSV. The relative activity may then be calculated by dividing the hypothetical reciprocal WHSV of the standard catalyst by the actual reciprocal WHSV of the test sorbent. The result is relative activity expressed in terms of a decimal fraction, which may then be multiplied by 100 to convert to % relative activity (relative activity may also be expressed as follows: relative activity at constant conversion is equal to the ratio of the WHSV of the test sorbent divided by the WHSV of the standard catalyst). To simplify this calculation, a MAT conversion vs. relative activity curve was developed utilizing a standard catalyst of 75 vol.% conversion to represent 100% relative activity. One such curve is shown in FIG. 1. In applying the results of this determination, a relative activity of 0.01, or 1%, means that it would take 100 times the amount of the operating sorbent to give the same conversion as the standard catalyst, i.e., the production sorbent is 1% as active as the reference catalyst.

Figure 7:
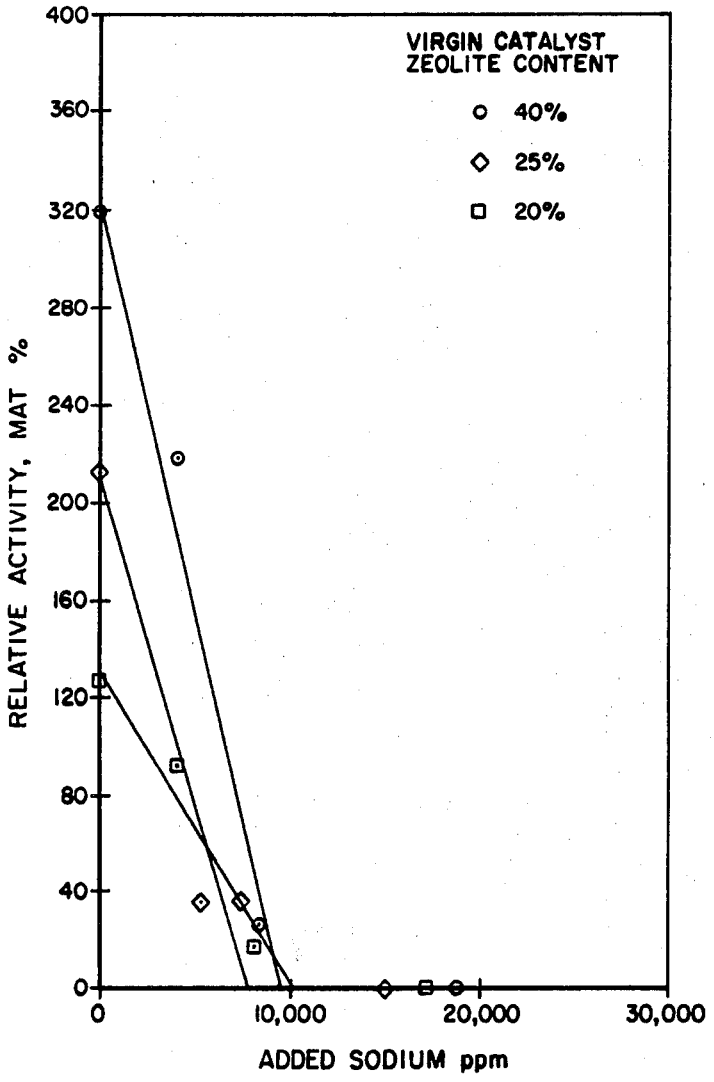
FIG. 7 is a graph showing the change in MAT relative activity of sorbent as the alkaline metal concentration on sorbent is increased.

The alkaline metal is added to neutralize the active acidic cracking sites remaining in the zeolite and/or matrix of preferably a deactivated, spent or equilibrium catalyst. FIG. 7 illustrates the amount of sodium required to neutralize the active cracking sites in three different commercially available equilibrium catalysts. The circles represent a catalyst containing 40 percent zeolite in the virgin state and designated here as "Catalyst D", the diamonds represent a catalyst with 60 percent of the zeolite content of Catalyst D, and the squares a catalyst containing 50 percent of the zeolite content of Catalyst D.

The neutralization effectiveness of sodium was evaluated in the laboratory by depositing sodium on a virgin catalyst. The virgin catalyst was subjected to severe thermal and steaming conditions according to a test sequence designated as calcining, impregnation and steaming (CIS) in order to approximate an equilibrium catalyst impregnated with sodium and used in an upgrading process. According to the CIS test, fresh catalyst is calcined at 1200° F. for 3 hours in a shallow bed, 100 gms of the dried material is then vacuum impregnated with about 0.5, 1.0 and 2.0 wt% of added sodium. Either aqueous solutions of sodium sulfate or pentane solutions of metal organic complexes are employed. Excess solvent is removed at 0.1 mm Hg pressure. The impregnated catalyst is oxidized at 1000° F. for 3 hours using a shallow bed and muffle furnace. After oxidation, the oxidized material is steamed at 1450° F. for 5 hours according to the Steaming Torture Test of Table 4. Samples are then tested for MAT activity, selectivities, surface area, zeolite and metal concentrations.

TABLE 4

STEAMING TORTURE TEST
FOR ACCELERATED DEACTIVATION
OF FLUID CRACKING CATALYST

PURPOSE:

This method outlines the deactivation procedure for impregnated and oxidized catalyst by hydrothermal treatment before the catalytic cracking activity is determined in the Micro-Activity Test (MAT).

TEST PARAMETERS:

Fluid-bed, quartz reactor, diameter-2.5 cm. ID
Catalyst load - 75 grams
Heat-up rate - 3° C./min.
Nitrogen gas velocity - 0.31 cm/sec. at 788° C.
Steam gas velocity - 10.9 cm/sec at 788° C.
Steam rate - 97% gas

TEST PROCEDURE:

Weigh fresh catalyst.
Charge loaded reactor to furnace at room temperature.
Begin flow of nitrogen at 0.05 SCFH rate.
Heat the reactor at maximum rate and begin the steaming period when 15° C. of desired steaming temperature is reached.
Start a flow of 100% steam at this temperature. Steam flow is continued for 5 hours. A nitrogen flow is used in addition to steam to provide constant fluidization.
Hold reactor at constant desired steaming temperature of 788° C. for duration of steaming.
After 5 hours, stop the steam and nitrogen flow to the reactor.
Remove reactor from furnace and allow to cool in air to ambient conditions.
Submit samples for testing.

CATALYST ANALYSES:

Deactivated catalyst is analyzed for the following parameters:
Surface Area by BET Method
MAT by Micro Activity Test
Mercury Pore Volume
Zeolite, Percent Relative Intensity to Na-Y by X-Ray diffraction.

TABLE 4-continued

STEAMING TORTURE TEST
FOR ACCELERATED DEACTIVATION
OF FLUID CRACKING CATALYST

As shown in FIG. 7, approximately 10,000 ppm of added sodium was required to neutralize the acid cracking sites of the "Catalyst D" series of samples so as to yield a sorbent with essentially no (zero) MAT activity. In further tests, a virgin catalyst containing about 9 wt% zeolite and 0.70 wt% sodium and having a MAT relative activity of about 100% after steaming was impregnated with sufficient sodium to raise the sodium content to 1.05 wt% and lower the MAT relative activity to about 0.35%, and another virgin catalyst containing about 18 wt% zeolite and 0.15% sodium and having a MAT relative activity of about 310% after steaming was impregnated with sufficient sodium to raise the sodium content to 1.65 wt% and lower the MAT relative activity about 0.06%, which equates to essentially no catalytic activity. (While 0.06% relative activity represents a finite but low level of conversion, i.e., 8 vol.%, this conversion of the feed is attributed to thermal as opposed to catalytic cracking.)

These series of tests should not be considered as establishing any limits on the amounts of alkaline metal required to neutralize the acid cracking sites of a deactivated, spent or equilibrium FCC or RCC catalyst. They are indicative of the results that one can obtain by carefully controlling the addition of the alkaline metal. The exact amount of alkaline metal required in an operating situation is dependent upon the severity of prior operations that the FCC or RCC equilibrium catalyst has experienced, such as metal deposition, hydrothermal history, regeneration temperatures, original zeolite content, stability and type of zeolite and the like, and upon the parameters of the catalyst treatment (neutralization) process.

UPGRADING PROCESSES

While the processes described in Ashland's RCC applications can handle crude oils, reduced crudes and other petroleum fractions containing high metals and Conradson carbon values not susceptible previously to direct processing, certain crudes such as Mexican Mayan or Venezuelan and certain other types of oil feeds contain abnormally high heavy metals and Conradson carbon values. If these very poor grades of oil are processed in a RCC process, they may lead to uneconomical operations because of high heat loads on the regenerator and/or high catalyst replacement rates to maintain adequate catalyst activity and/or selectivity. In order to improve the quality of such very poor grades of oil, such as those containing more than 50 ppm heavy metals and/or more than 8 weight percent Conradson carbon and preferably more than 100 ppm heavy metals and/or more than 10 weight percent Conradson carbon, these oils are pretreated with the select sorbent of the invention to reduce the levels of these contaminants to the aforementioned or lower values. One upgrading process thay may be utilized for this purpose is described in U.S. Pat. No. 4,263,128 issued Apr. 21, 1981, in the name of David B. Bartholic, the entire disclosure of said patent being incorporated herein by reference. A preferred mode of upgrading residual oils in practicing the present invention is disclosed in PCT patent application Ser. No. PCT/US81/00648, filed May 13, 1981, in the names of Oliver J. Zandona, Dwight F. Barger, Paul W. Walters and Lloyd E. Busch and entitled A COMBINATION PROCESS FOR UPGRADING RESIDUAL OILS, the entire disclosure of said PCT application being incorporated herein by reference.

Certain feeds processed in the past by RCC units because of their metals and/or Conradson carbon content could be processed instead in FCC units if the levels of these contaminates could be lowered by an amount sufficient to yield an FCC feed. For example, a relatively small amount (5–25%) of reduced crude or other heavy hydrocarbon feedstock may be mixed with VGO and the blend upgraded to provide an FCC feed. Alternatively, a reduced crude or other heavy fraction may first be upgraded and then a relatively small amount (5–25%) of the upgraded fraction mixed with VGO to provide an FCC feed. Therefore the present invention also contemplates upgrading RCC type feeds to a quality capable of being cracked economically in conventional FCC processes and apparatuses.

Representative feedstocks contemplated for use with the invention include whole crude oils; light fractions of crude oils such as light gas oils (LGO), heavy gas oils (HGO), and vacuum gas oils (VGO); and heavy fractions of crude oils such as topped crude, reduced crude, vacuum fractionator bottoms, other fractions containing heavy residua, coal-derived oils, shale oils, waxes, untreated or deasphalted residua, and blends of such fractions with gas oils and the like. A poor grade of FCC feedstock for which the invention is particularly useful is one having a Conradson carbon value greater than about 1.0, preferably greater than about 2.0, and containing greater than 0.5 ppm, preferably greater than 1.0 ppm, total heavy metals. A poor grade of RCC feedstock is one having a Conradson carbon value greater than about 8, preferably greater than about 10, and containing greater than 50 ppm, preferably greater than 100 ppm, total heavy metals.

The greater the heavy metals content of the particular type (e.g. RCC or FCC) of oil stock to be upgraded and the greater the proportion of vanadium in that heavy metal content, the more advantageous the sorbent and processes of this invention becomes. A high vanadium feed for FCC processing is one having more than about 0.1 ppm vanadium, more preferably more than about 1.0 ppm and most preferably about 2.0 to about 5.0 ppm. A high vanadium feed for RCC processing is one having more than about 1.0 ppm vanadium, preferably more than about 5.0 ppm and most preferably more than about 20 ppm. In either case, the invention is particularly effective where the weight ratio of vanadium to nickel in the feed is in the range of from about 1:3 to 5:1, preferably greater than about 1:1, more preferably greater than about 2:1 and most preferably greater than about 3:1.

Although it is necessary to maintain low sodium values in the feed to practice the art of catalytic cracking as taught in the literature, it is not necessary to maintain low sodium levels in the feed to practice the present invention. The invention is particularly useful in treating feeds containing greater than 50 ppm sodium, preferably greater than 100 ppm and more preferably greater than 200 ppm.

A particularly preferred FCC feedstock for upgrading by the process of the invention includes VGO, LGO and/or HGO mixed with 5 to 25 wt% of a reduced crude to provide a blend having a total heavy metals content greater than about 4 ppm of which at least about 2 ppm is vanadium, a vanadium to nickel atomic ratio of at least about 1.0, and a Conradson carbon value of at least about 2.0. A particularly preferred RCC feedstock for upgrading by the process of the invention includes a reduced crude comprising 70% or more of a 650° F.+ material having a fraction greater than 20% boiling above about 1,025° F. at atmospheric pressure, a total heavy metals content of greater than about 50 ppm of which at least about 25 ppm is vanadium, a vanadium to nickel atomic ratio of at least about 1.0, and a Conradson carbon value greater than about 8.0. This RCC feed may also have a hydrogen to carbon ratio of less than about 1.8 and coke precursors in an amount sufficient to yield greater than about 10% coke by weight based on fresh feed.

The process according to the methods of the invention will produce coke in amounts of 1 to 14 percent by weight based on weight of fresh feed. This coke is laid down on the sorbent in amounts in the range of about 0.3 to 3 percent by weight of sorbent, depending upon the sorbent to oil ratio (weight of sorbent to weight of feedstock) in the riser and upon the Conradson carbon value of the particular feed. The severity of the process should be sufficiently low so that conversion of the feed to gasoline and lighter products is below 20 volume percent, preferably below 10 volume percent and more preferably below 5 volume percent. Even at these low levels of severity, the upgrading process is effective to reduce Conradson carbon values by at least 20 percent, preferably in the range of 40 to 80 percent, and heavy metals content by at least 50 percent, preferably in the range of 75 to 90 percent.

The invention may be practiced in a wide variety of apparatus. However, the preferred apparatus includes means for rapidly vaporizing as much feed as possible and efficiently admixing feed and sorbent (although not necessarily in that order), for causing the resultant mixture to flow as a dilute suspension in a progressive-flow mode, and for separating the sorbent from the upgraded feed and lighter products at the end of a predetermined residence time or times, it being preferred that all or at least a substantial portion of the product should be abruptly separated from at least a portion of the sorbent.

For example, the apparatus may include, along its elongated reaction chamber, one or more points for introduction of carbo-metallic feed, one or more points for introduction of diluent material, one or more points for withdrawal of products and one or more points for withdrawal of sorbent.

It is preferred that the contact chamber, or at least the major portion thereof, be more nearly vertical than horizontal and have a length-to-diameter ratio of at least about 10, more preferably about 20 or 25 or more. Use of a vertical riser is preferred. This MRS riser is referred to in this specification as the "contactor" to avoid confusion with the FCC or RCC catalytic conversion riser. If tubular, the contactor can be of uniform diameter throughout or may be provided with a continuous or step-wise increase in diameter along the contact path to maintain or vary the velocity along the flow path.

The means for introducing feed, sorbent and other materials into the contact chamber may range from open pipes to sophisticated jets or spray nozzles, it being preferred to use means capable of breaking up or atomizing the liquid feed into fine droplets. A particularly preferred atomization and solids contacting process for heavy oils is disclosed in U.S. patent application Ser. No. 263,391, filed on May 13, 1981, in the name of William P. Hettinger, Jr., et al., and entitled "Process for Cracking High-Boiling Hydrocarbons Using High Pore Volume, Low Density Catalyst", the entire disclosure of which is incorporated herein by reference. Preferably, the sorbent, liquid water (when used) and fresh feed are brought together in an apparatus similar to that disclosed in U.S. patent application Ser. No. 969,601 of George D. Myers, et al., filed Dec. 14, 1978, the entire disclosure of which is incorporated herein by reference. According to a particularly preferred embodiment based on a suggestion which is believed to have emanated from Mr. Stephen M. Kovach at Ashland, the liquid water and carbo-metallic oil, prior to their introduction into the riser, are caused to pass through a propeller, apertured disc, or any other appropriate high shear agitating means for forming a "homogenized mixture" containing finely-divided droplets of oil and/or water with the droplets of one preset in a continuous phase of the other.

In general, the charging means (for sorbent, feed and diluent) and the contactor configuration are such as to provide a relatively high velocity of flow and a relatively dilute suspension of sorbent and feed. For example, the vapor and sorbent velocity in the contactor will be usually at least about 25 or more, typically at least about 35 feet per second. This velocity is preferably at least about 55, more preferably about 75 and most preferably about 100 feet per second and higher. The vapor velocity at the top of the contactor may be lower than that at the bottom with the above specified velocities being at the bottom. The velocity capabilities of the contactor will in general be sufficient to prevent substantial build-up of a sorbent bed in the bottom or other portions of the contactor, whereby the sorbent loading in the contactor can be maintained below about 3 or 4 pounds, as for example about 1.2 pounds, and below about 2 pounds, as for example 0.8 pounds, per cubic foot, respectively, at the upstream (e.g., bottom) and downstream (e.g., top) ends of the contactor.

The progressive flow mode involves, for example, flowing of sorbent, feed, diluent and products as a stream in a positively controlled and maintained direction established by the elongated nature of the reaction zone. This is not to suggest however that there must be strictly linear flow. Turbulent flow and "slippage" of sorbent relative to vapor may occur to some extent especially in certain ranges of vapor velocity and sorbent loading. It is preferable to employ sufficiently low sorbent loadings and sufficiently high vapor velocities to restrict slippage and back-mixing and provide very short contact times.

Most preferably the contactor is one which abruptly separates a substantial portion or all of the vaporized products from the sorbent at one or more points along a riser, and preferably separates substantially all of the vaporized products from the sorbent at the downstream end of a riser. A preferred type of contactor embodies ballistic separation of the sorbent and products; that is, sorbent is projected in a direction established by the riser tube, and is caused to continue its motion in the general direction so established, while the products, having lesser momentum, are caused to make an abrupt change of direction, resulting in an abrupt, substantially instantaneous separation of product from sorbent. In a preferred embodiment referred to as a vented riser, the riser tube is provided with a substantially unobstructed discharge opening at its downstream end for discharge of sorbent. An exit port adjacent the downstream end of the riser tube receives the products. The discharge opening communicates with a sorbent flow path which includes a stripper and sorbent regenerator, while the exit port communicates with a product flow path which is substantially or entirely separated from the sorbent flow path and leads to separation means for separating the products from the relatively small portion of sorbent, if any, which manages to gain entry to the product exit port. Examples of ballistic separation apparatuses and techniques as above described are found in U.S. Pat. Nos. 4,066,533 and 4,070,159 to Myers, et al., the entire disclosures of which are incorporated herein by reference.

The mode of sorbent/product separation presently deemed best for practicing the present invention is disclosed in a U.S. patent application Ser. No. 263,394, filed on May 13, 1981, in the names of Paul W. Walters, Roger M. Benslay, and Dwight F. Barger, entitled CARBO-METALLIC OIL CONVERSION WITH BALLISTIC SEPARATION. The ballistic separation step preferably includes at least a partial reversal of direction by the product vapors upon discharge from the riser tube; that is, the product vapors make a turn or change of direction which may exceed 90° at the riser tube outlet. This may be accomplished for example by providing an annular cup-like member surrounding the riser tube at its upper end, the ratio of cross-sectional area of the annulus of the cup-like member relative to the cross-sectional area of the riser tube outlet being preferably in the range of about 0.7 to about 1.2 and more preferably about 1.0. Preferably the lip of the cup is slightly upstream of, or below the downstream end or top of the riser tube. By means of a product vapor line communicating with the interior of the cup but not the interior of the riser tube and having its inlet positioned within the cup interior upstream of the riser tube outlet, product vapors emanating from the riser tube and entering the cup by an abrupt change of direction are transported away from the cup to auxiliary sorbent and product separation equipment downstream of the cup, e.g., a cyclone separator. Such an arrangement can produce a high degree of completion of the separation of sorbent from product vapors at the vented contactor outlet, so that the required amount of auxiliary sorbent separation equipment such as cyclones is greatly reduced, with consequent large savings in capital investment and operating cost.

Preferred conditions for operation of the process are described below. Among these are feed, sorbent and contact temperatures, contact and feed pressures, residence times and levels of conversion.

In conventional FCC operations with VGO, the feedstock is customarily preheated, often to temperatures significantly higher than are required to make the feed sufficiently fluid for pumping and for introduction into the riser. For example, preheat temperatures as high as about 700° or 800° F. have been reported. In the MRS process as presently practiced, it is preferred to restrict preheating of the feed, so that the feed is capable of absorbing a larger amount of heat from the sorbent while the sorbent raises the feed to a viscosity breaking (visbreaking) temperature, at the same time minimizing the amount of feedstock cracked or otherwise converted to gaseous products. Thus, where the nature of the feedstock permits, it may be fed at ambient temperature. Heavier stocks may be fed at preheat temperatures of up to about 600° F., typically about 200° F. to about 500° F., but higher preheat temperatures are not necessarily excluded.

The larger the amount of coke which must be burned from a given weight of sorbent, the greater the potential for exposing the feed to excessive temperatures. In addition, the large pore structure and pore volume of the select sorbents may be susceptible to thermal and/or hydrothermal degradation at temperatures near the upper end of the temperature range for sorbent regeneration. The use of such large pore sorbents for upgrading carbo-metallic feeds creates a need for regeneration techniques which will not destroy the sorbent matrix by exposure to highly severe temperatures and steaming. Such need can be met by a multi-stage regeneration process which includes conveying coked sorbent into a first regeneration zone and introducing oxidizing gas thereto. The amount of oxidizing gas that enters said first zone and the concentration of oxygen or oxygen-bearing gas therein are sufficient for only partially affecting the desired conversion of coke on the sorbent to carbon oxide gases. The partially regenerated sorbent is then removed from the first regeneration zone and is conveyed to a second regeneration zone. Oxidizing gas is introduced into the second regeneration zone to provide a higher concentration of oxygen or oxygen-containing gas than in the first zone, to complete the removal of carbon to the desired level. The regenerated sorbent may then be removed from the second zone and recycled to the contactor for contact with fresh feed. An example of such a multi-stage regeneration process is described in U.S. patent application Ser. No. 969,602 in the name of George D. Myers, et al., filed Dec. 14, 1978, the entire disclosure of which is incorporated herein by reference. Another example may be found in U.S. Pat. No. 2,398,739.

Multi-stage regeneration offers the possibility of combining oxygen-deficient regeneration with the control of the $CO:CO_2$ molar ratio. Thus, about 50% or more, more preferably about 65% to about 95%, and more preferably about 80% to about 95% by weight of the coke on the sorbent immediately prior to a final regeneration stage may be removed in one or more preceding stages of regeneration in which the molar ratio of $CO_2:CO$ is maintained at a level substantially below 5, preferably about 4 or less, more preferably about 2 or less and most preferably about 1.0 or less. In combination with the foregoing, the last 5% or more, or 10% or more by weight of the coke originally present, up to the entire amount of coke remaining after the preceding stage or stages, can be removed in a subsequent stage of regeneration in which more oxygen is present. Such process is susceptible of operation in such a manner that the total flue gas recovered from the entire, completed regeneration operation contains little or no excess oxygen, e.g., on the order of about 0.2 mole percent or less, or as low as about 0.1 mole percent or less, which is substantially less than the 2 mole percent which has been suggested for catalysts. Thus, multi-stage regeneration is particularly beneficial in that it provides another convenient technique for restricting regeneration heat transmitted to fresh feed via regenerated sorbent and/or for reducing the potential for thermal degradation of the sorbent, while simultaneously affording an opportunity to reduce the carbon level on regenerated sorbent to those very low percentages (e.g., about 0.1% or less) which particularly enhance the upgrading capacity of the sorbent. For example, a two-stage regeneration process may be carried out with the first stage burning about 80% of the coke at a bed temperature of about 1400° F. to produce CO and $CO_2$ in a molar ratio of $CO_2/CO$ of about 1 and the second stage burning about 20% of the coke at a bed temperature of about 1370° F. to produce substantially all $CO_2$ mixed with free oxygen. Use of the gases from the second stage as combustion-supporting gases for the first stage, along with additional air introduced into the first stage bed, may result in an overall $CO_2$ to CO ratio of about 1.5, with a sorbent residence time of about 5 to 20 minutes or more in the two zones. Moreover, where the regeneration conditions are substantially more severe in the first zone than in the second zone (e.g., higher zone or localized temperatures and/or more severe steaming conditions), that part of the regeneration sequence which involves the most severe conditions is performed while there is still an appreciable amount of coke on the sorbent. Such operation may provide some protection of the sorbent from the more severe conditions. A particularly preferred embodiment of the invention is two-stage fluidized regeneration at a maximum temperature of about 1500° F. with a reduced temperature by as much as about 20° to 30° F. or more in the dense phase of the second stage as compared to the dense phase of the first stage, and with reduction of carbon on sorbent to about 0.1% or less by weight of sorbent in the second zone.

The $CO_2/CO$ ratio also may be decreased by providing chlorine in an oxidizing atmosphere within the regeneration zone, the concentration of chlorine preferably being in the range of about 100 to about 400 ppm. This method of decreasing the $CO_2/CO$ ratio is disclosed in copending applications Ser. No. 247,751 filed Mar. 23, 1981, for "Addition of $MgCl_2$ to Catalyst" and Ser. No. 246,782 filed Mar. 23, 1981, for "Addition of Chlorine to Regenerator", both in the name of George D. Myers, the entire disclosures of said copending applications being incorporated herein by reference.

U.S. patent applications Ser. Nos. 94,092 and 94,227 (now U.S. Pat. Nos. 4,332,673 and 4,354,923 respectively) referenced below disclosure processes for the conversion of carbo-metallic oils to liquid fuel in which various regeneration techniques are employed that assist in controlling the heat load in the regeneration step. Another method of controlling the heat load in catalyst regeneration is disclosed in U.S. patent application Ser. No. 251,032 for "Addition of Water to Regenerator Air" filed Apr. 3, 1981, by George D. Myers, et al., the entire disclosure of this application being incorporated herein by reference. These or similar methods may also be employed for controlling the heat load in regenerating the sorbent of the present invention.

The regeneration apparatus for removing coke deposited on the sorbent by the MRS upgrading process is referred to in this specification as a "combustor" in order to avoid confusing this apparatus with FCC and RCC catalyst regenerators, although these three apparatuses may be of the same or a similar construction. In most circumstances, it will be important to ensure that no adsorbed oxygen-containing gases are carried into the contactor by sorbent recycled from the combustor. Thus, whenever such action is considered necessary, the sorbent discharged from the combustor may be stripped with appropriate stripping gases to remove oxygen containing gases. Such stripping may for instance be conducted at relatively high temperatures, for example about 1350° F. to about 1370° F., using steam, nitrogen or other inert gas as the stripping gas(es). The use of nitrogen and other inert gases is beneficial from the standpoint of avoiding a tendency toward hydrothermal sorbent degradation which may result from the use of steam.

With respect to the tolerance levels of heavy metals on the sorbent itself, such metals may accumulate on the sorbent to levels in the range of from about 3,000 to 70,000 ppm of total metals, preferably 10,000 to 30,000 ppm, of which 5 to 100%, preferably 20 to 80% is vanadium. Additives may be introduced into the contactor, the combustor or other upgrading system components to passivate the non-selective catalytic activity of these levels of heavy metals on the sorbent. Preferred additives for this purpose include those disclosed in copending U.S. patent application Ser. No. 263,395, referenced above. Other metal additives specifically for reducing the adverse effects of vanadium on sorbent may also be employed as described in PCT International Application Ser. No. PCT/US81/00357 filed in the U.S. Receiving Office on Mar. 19, 1981, in the names of Ashland Oil, Inc., et al., and entitled "Immobilization of Vanadia Deposited on Sorbent Materials During Treatment of Carbo-Metallic Oils", the entire disclosure of said PCT international application being incorporated herein by reference.

Figure 2:
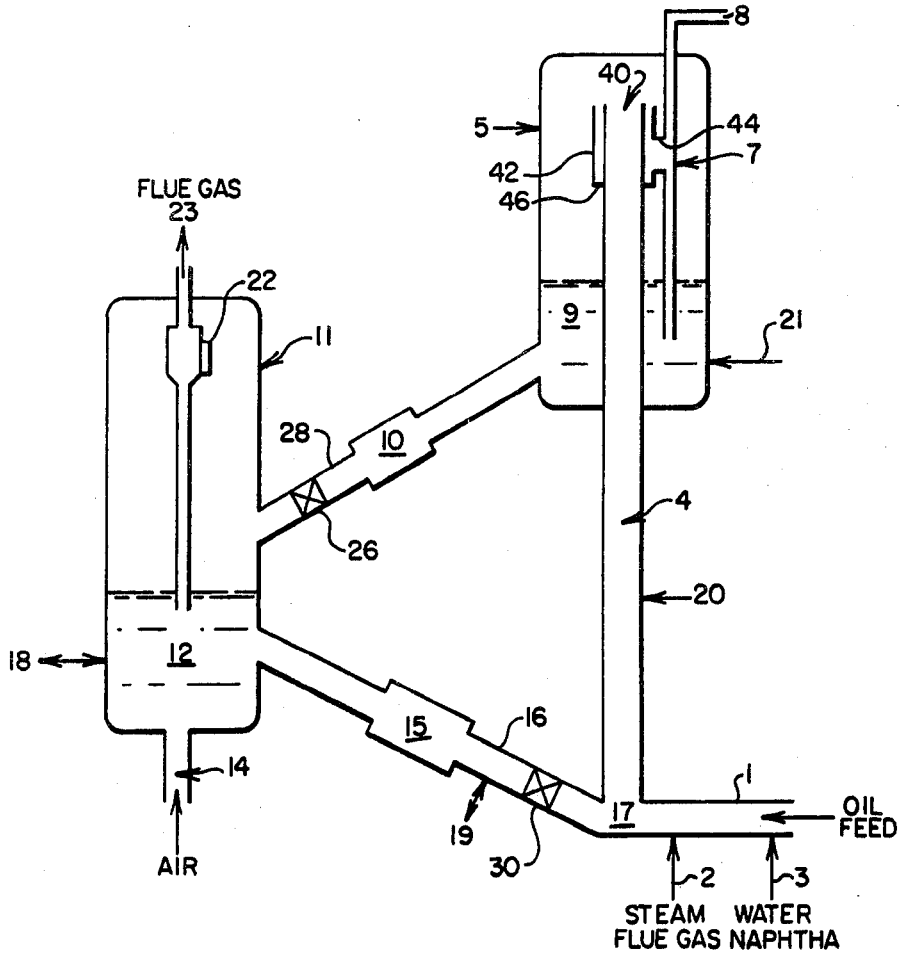
FIG. 2 is a schematic diagram of an apparatus for carrying out an upgrading process according to the invention.

Referring to FIG. 2, a MRS feed is introduced into the bottom of a progressive flow contactor 4 along with a suspension of hot sorbent prepared in accordance with this invention. Steam, naphtha, water, flue gas and/or some other diluent is preferably introduced into the contactor along with the feed. These diluents may be from a fresh source or may be recycled from a process stream in the refinery. Where recycle diluent streams are used, they may contain hydrogen sulfide and other sulfur compounds which may help passivate adverse catalytic activity by heavy metals accumulating on the sorbent. It is to be understood that water diluents may be introduced either as a liquid or as steam. Diluents are added primarily as a source of vapor for dispersing the feed and/or accelerating the feed and sorbent to achieve the vapor velocity and residence time desired. Diluents other than water need not be added but where used, the total amount of diluent specified includes the amount of water used. Increases in diluent will further increase the vapor velocity and further lower the feed partial pressure in the riser.

As the feed travels up the contactor 4, it forms basically four products known in the industry as dry gas, wet gas, naphtha, and RCC or FCC feed. The naphtha is of relatively low octane and either may be sent to a reforming operation to increase its octane number or combined with the RCC or FCC feed to form a blend which may be cracked and reformed in a subsequent conversion unit. At the upper end of the contactor, the sorbent particles are ballistically separated from product vapors. The sorbent which then contains the coke formed in the contactor is sent to the combustor 11 to burn off the coke and the separated product vapors are sent to a fractionator (not shown) for further separation and treatment to provide the four basic products indicated. The preferred conditions for contacting feed and sorbent in the contactor are summarized in Table 5, in which the abbreviations used have the following meanings: "Temp." for temperature, "Dil." for diluent, "pp" for partial pressure, "wgt" for weight, "V" for vapor, "Res." for residence, "S/O" for sorbent to oil ratios, "sorb." for sorbent, "bbl" for barrel, "MAT" for microactivity by the MAT test using a standard Davison feedstock, "Vel." for velocity, "cge" for charge, "d" for density and "Reg." for regenerated.

TABLE 5

| | Sorbent Riser Conditions | |
|---|---|---|
| Parameter | Board Operating Range | Preferred Range |
| Feed Temp. | 400–800° F. | 400–650° F. |
| Steam Temp. | 20–500° F. | 300–400° F. |
| Reg. Sorbent Temp. | 900–1600° F. | 1150–1500° F. |
| Riser Exit Temp. | 800=1400° F. | 900–1100° F. |
| Pressure | 0–100 psia | 10–50 psia |
| Water/Feed | 0.01–0.30 | 0.04–0.15 |
| Dil. pp/Feed pp | 0.25–3.0 | 1.0–2.5 |
| Dil. wgt/Feed wgt | ≦0.4 | 0.1–0.3 |
| V. Res. Time | 0.1–5 sec. | 0.5–3 sec. |
| S/O, wgt | 3–18 | 5–12 |
| Lbs. Sorb./bbl Feed | 0.1–4.0 | 0.2–2.0 |
| Inlet Sorb. MAT | <25 vol. % | <20 vol. % |
| Inlet Sorb. Rel. Act. | <1% | <0.5% |
| Outlet Sorb. MAT | <20 vol. % | <10 vol. % |
| Outlet Sorb. Rel. Act. | <0.5% | <0.1% |
| V. Vel. | ≧25 ft./sec. | ≧30 ft./sec. |
| V. Vel./Sorb. Vel. | ≧1.0 | 1.2–2.0 |
| Dil. Cge. Vel. | 5–90 ft./sec. | 10–50 ft./sec. |
| Oil Cge. Vel. | 1–50 ft./sec. | 5–50 ft./sec. |
| Inlet Sorb. d | 1–9 lbs./ft.$^3$ | 2–6 lbs./ft.$^3$ |
| Outlet Sorb. d | 1–6 lbs./ft.$^3$ | 1–3 lbs./ft.$^3$ |

Sorbent particle circulation and operating parameters are brought up to process conditions by methods well-known to those skilled in the art. The equilibrium sorbent at a temperature of 1,150°–1,500° F. contacts the oil feed at riser wye 17. The feed can contain steam and/or flue gas injected at point 2 or water and/or naphtha injected at point 3 to aid in feed vaporization, sorbent fluidization and controlling contact time in contactor riser tube 4. The feed is passed through contactor 4 in contact with the hot fluidized inert sorbent to effect removal of metal contaminants and coke precursors by thermal degradation of high boiling and/or non-vaporizable materials in the feed. The liquid feed product provided by thermal degradation of these materials also has a lower viscosity so that this process may be referred to as a viscosity breaking or "visbreaking" process.

The sorbent and vaporous hydrocarbons travel up contactor 4 at a contact time of 0.1–5 seconds, preferably 0.1–3 seconds and more preferably 0.5–2 seconds. At the upper end of contactor 4, the product vapors are ballistically separated from the sorbent particles in vessel 5. The riser tube of contactor 4 is of the vented type having an open upper end 40 surrounded by a cup-like member 42 which preferably stops just below the upper end 40 of the riser so that the lip of the cup is slightly upstream of the open riser tube as shown in FIG. 2. A product vapor line 44 communicates with the interior of the cup so as to discharge product vapors entering the cup from the vapor space of vessel 5. The cup forms an annulus 46 around and concentric to the upper end of the riser tube. The transverse cross-sectional area of annulus 46 is preferably in the range of 70% to 120%, more preferably about 100%, of the transverse cross-sectional area of the riser tube. This structure causes product vapors to undergo almost a complete reversal in their direction of flow upon being discharged from the riser tube and before leaving the vapor spaced of vessel 5. The product vapors then make a further turn or change in direction of about 90° as they enter product line 44. The product vapors then enter a cyclone separator 7 having an overhead vapor conduit 8. The amount of particle carry-over with this flow reversal structure may be reduced by a factor of about 5 or more relative to carry-over with the basic vented riser arrangement described in U.S. Pat. Nos. 4,066,533 and 4,070,159. Due to this reduction in carry-over, cyclone separator 7 may comprise only a single cyclone stage instead of having multiple stages as is usually required to prevent excessive carry-over of catalyst fines into the overhead vapor line in prior vented riser applications.

The sorbent and vaporous hydrocarbons are separated at vented riser outlet 40 at a final contact temperature of about 900°–1100° F. The vaporous hydrocarbons are transferred to cyclone 7 via cup 42 and conduit 44 where any entrained sorbent fines are separated and the hydrocarbon vapors are sent to a fractionator (not shown) via vapor transfer line 8. The coked sorbent is transferred to coked sorbent stripper 10 for removal of entrained hydrocarbon vapors. One method that may be employed in stripping residual hydrocarbons from coked sorbent is described in international patent application Ser. No. PCT/US81/00646 filed on May 13, 1981, in the name of Ashland Oil, Inc., et al., and entitled "Stripping Hydrocarbons from Catalyst with Combustion Gases", the entire disclosure of said PCT application being incorporated herein by reference.

Stripped sorbent is then transferred to combustor vessel 11 to form a dense fluidized bed 12. An oxygen containing gas such as air is admitted to the bottom of dense bed 12 by conduit 14 to combust the coke to carbon oxides. The regenerating gas may be any gas which can provide oxygen to convert carbon to carbon oxides. Air is highly suitable for this purpose in view of its ready availability. The amount of air required per pound of coke for combustion depends upon the desired carbon dioxide to carbon monoxide ratio in the effluent gases and upon the amount of other combustible materials present in the coke, such as hydrogen, sulfur, nitrogen and other elements capable of forming gaseous oxides at regeneration conditions. The combustor vessel illustrated in FIG. 2 is a simple one zone-dense bed type. This regenerator apparatus is not limited to this example but may comprise two or more zones in stacked or side by side relation and with internal and/or external transfer lines from zone to zone. Such multistage regenerators are described in more detail in Ashland's RCC applications as referenced herein.

The combustor is operated at temperatures in the range of about 900° to 1,600° F., preferably 1,150° to 1,500° F., to achieve adequate combustion while keeping sorbent temperatures below those at which significant sorbent degradation can occur. In order to control these temperatures, it is necessary to control the rate of burning which, in turn, can be controlled at least in part by the relative amounts of oxidizing gas and carbon introduced into the regeneration zone per unit time. With reference to FIG. 2, the rate of introducing carbon into the combustor may be controlled by regulating the rate of flow of coked sorbent through valve 26 in conduit 28, the rate of removal of regenerated sorbent by regulating valve 30 in conduit 16, and the rate of introducing oxidizing gas by the speed of operation of blowers (not shown) supplying air to the conduit 14. These parameters may be regulated such that the ratio of carbon dioxide to carbon monoxide in the effluent gases is equal to or less than about 4.0, preferably equal to or less than about 1.5. In addition, water, either as liquid or steam, may be added to the combustor to help control temperatures and to influence the carbon dioxide to carbon monoxide ratio. A particularly preferred mode of operating the combustor so as to control the $CO_2/CO$ ratio and regenerate sorbent in a manner which helps minimize the adverse effects of vanadia is disclosed in U.S. patent application Ser. No. 255,931 filed on Apr. 20, 1981, in the name of William P. Hettinger, Jr., et al., and entitled "Immobilization of Vanadia Deposited on Sorbent Materials During Treatment of Carbo-Metallic Oils", the entire disclosure of said application being incorporated herein by reference.

The regenerator combustion reaction is carried out so that the amount of carbon remaining on regenerated sorbent is less than about 0.50 percent, preferably less than about 0.25 percent and most prefereably less than about 0.10 percent on a substantially moisture-free weight basis. The residual carbon level is ascertained by conventional techniques which include drying the sorbent at 1,100° F. for about four hours before actually measuring the carbon content so that the carbon level obtained is on a moisture-free basis.

The flue gas resulting from sorbent regeneration is processed through a multi-stage cyclone 22 and exits from combustor vessel 11 via line 23. The regenerated sorbent is transferred to regenerated sorbent stripper 15 to remove any entrained combustion gases and then transferred to riser wye 17 via line 16 to repeat the processing cycle.

At such time as the heavy metals level (Ni+V+Fe+Cu) on the sorbent becomes intolerably high so that sorbent effectiveness declines unduly and/or catalytic cracking activity increases unduly, additional sorbent can be added and deactivated sorbent withdrawn at addition-withdrawal point 18 into dense bed 12 of combustor 11 and/or at addition-withdrawal point 19 into regenerated sorbent standpipe 16. Addition-withdrawal points 18 and 19 can be utilized to add either untreated used catalyst or used catalyst already treated so as to contain one or more alkaline metal additives of the invention.

In the case of a catalytically active sorbent without additive, the alkaline metal additive may be introduced into the sorbent material as an aqueous or hydrocarbon solution or as a volatile compound during the processing cycle. The alkaline metal additive as an aqueous solution or as an organo-metallic compound in an aqueous and/or hydrocarbon solvent is preferably added directly to the sorbent at points 18 and 19, and/or mixed with the feed at addition points 2 and 3 into feed line 1. Addition point 20 into contactor 4 and addition point 21 into sorbent bed 9 in vessel 5 may also be employed for this purpose. The addition of the alkaline metal additive is not limited to these locations, but can be introduced at any point in the oil/sorbent processing cycle. With reference to FIG. 2, this would include, but not be limited to, addition of the alkaline metal additive solution at the contactor wye 17, anywhere along the length of contactor 4, to the dilute phase in sorbent separator vessel 5, to the strippers 10 and 15, to the combustor air inlet 14, to the combustor dilute phase, and/or anywhere along regenerated sorbent standpipe 16.

COMBINED MRS AND RCC PROCESSES

The vanadia immobilizing sorbents and the metals-Conradson carbon removal processes described in this specification are preferably employed in combination with processes and apparatuses for carbo-metallic oil conversion (RCC) of the type described in co-pending U.S. applications Ser. Nos. 94,091, 94,092, 94,216, 94,217 and 94,227, all filed Nov., 14, 1979; and Ser. Nos.

246,751, 246,782 and 246,791, all filed March 23, 1981; said applications being in the name of George D. Myers alone or jointly with Lloyd E. Busch and the entire disclosure of each of said applications being incorporated herein by reference. For example, the spent catalyst from one of these RCC processes may be treated and used according to the present invention and the liquid product of the upgrading process of the invention may be used as a feed for the same or a different RCC process. Other RCC conversion and/or catalyst regeneration processes that may be combined with the upgrading processes of the present invention include those described in U.S. applications Ser. No. 263,398, filed on May 13, 1981, and Ser. No. 258,265 filed on Apr. 28, 1981, both in the name of William P. Hettinger, Jr., and others, and in international application Ser. No. PCT/US81/00662 filed in the name of Ashland Oil, Inc., et al., on May 13, 1981, the entire disclosures of said U.S. and international applications being incorporated herein by reference.

The preferred feeds capable of being cracked by these RCC methods and apparatuses are comprised of 100% or less of 650° F.+ material of which at least 5 wt%, preferably at least 10 wt%, is of high molecular weight and does not boil below about 1,025° F. The terms "high molecular weight" and/or "heavy" hydrocarbons refer to those hydrocarbon fractions having a normal boiling point of at least 1,025° F. and include non-boiling hydrocarbons, i.e., those materials which may not boil under any conditions.

A carbon-metallic feed for purposes of RCC processing is one having a heavy metal content of at least about 4 ppm nickel equivalents (ppm total metals being converted to nickel equivalents by the formula: Ni Eq.$=Ni+V/4.8+Fe/7.1+Cu/1.23$) and a Conradson carbon residue value greater than about 1.0. The upgraded feeds for which RCC processing is particularly useful will have a heavy metal content of at least about 5 ppm nickel equivalents, a vanadium content of at least 2.0 ppm, and a Conradson residue of at least about 2.0.

With respect to the tolerance levels of heavy metals on RCC cracking catalysts, such metals may accumulate on these catalysts to levels in the range of from about 3,000 to 70,000 ppm of total metals, preferably 10,000 to 30,000 ppm and more preferably 15,000 to 20,000 ppm, of which preferably 5 to 100%, more preferably 20 to 80%, may be vanadium.

Figure 3:
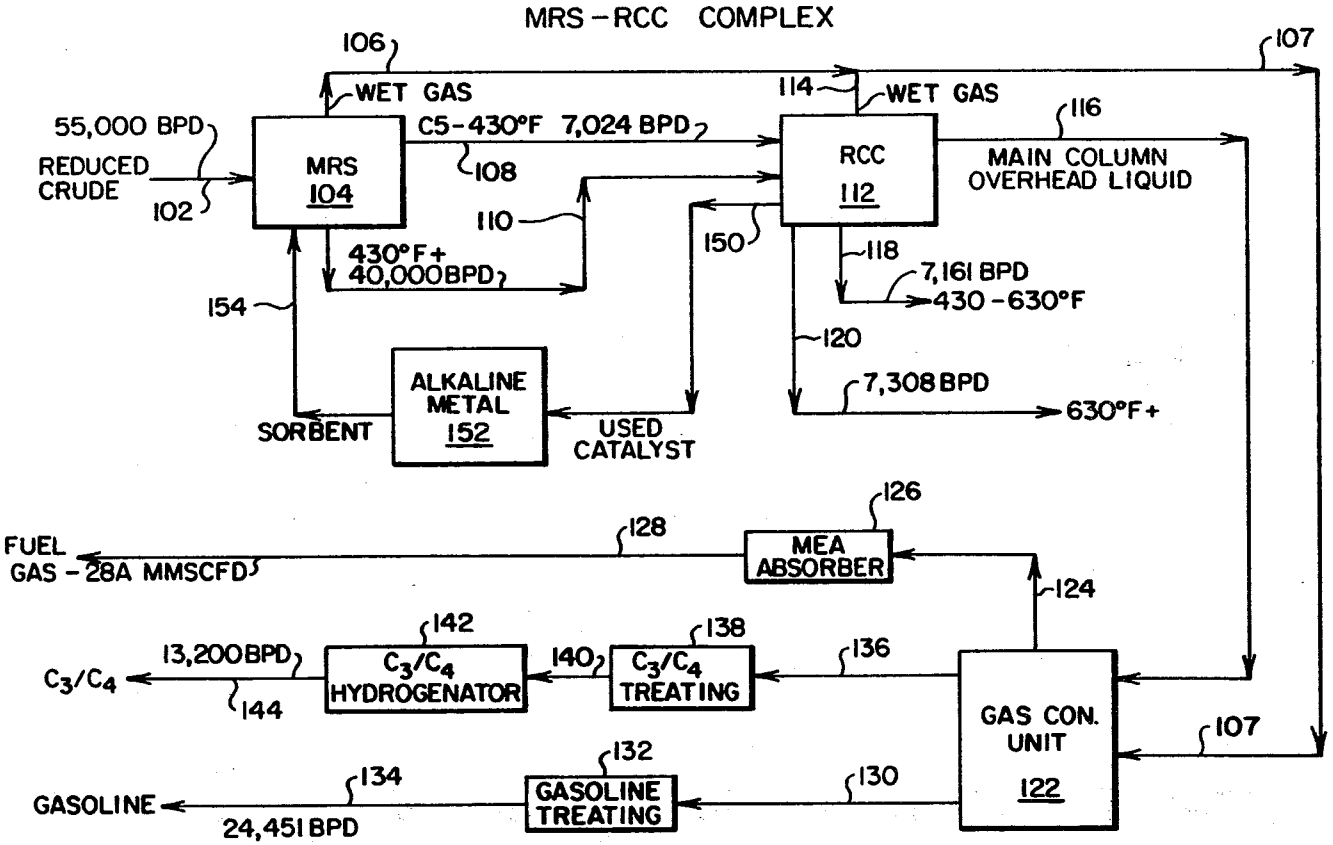
FIG. 3 is a schematic block diagram illustrating one flow arrangement of a MRS process for upgrading poor grades of reduced crude integrated with a RCC process for catalytically cracking the MRS liquid product and for providing used cracking catalyst to be neutralized and used as sorbent in the MRS process.

Referring now to FIG. 3 by way of example, there is shown a simplified block flow arrangement of a combination process according to the invention. In the arrangement of FIG. 3, a high boiling hydrocarbon feed such as a reduced crude is charged by conduit 102 to a MRS upgrading system 104 wherein the feed is contacted with the solid sorbent particulate material of the invention to thermally visbreak the feed so as to reduce its Conradson carbon value and metal contaminants to a lower, more acceptable level. During this thermal contacting operation with solid sorbent particulates, a wet gas product is formed and recovered by conduit 106, a $C_5$+ naphtha product is formed and recovered by conduit 108 and a 430° F.+ product is formed and recovered by conduit 110.

The $C_5$ plus product material in conduit 108 and the 430° F.+ product material in conduit 110 are charged to an RCC (reduced crude cracking) unit 112 more fully discussed below with respect to FIGS. 4 and 5. During catalytic cracking conversion of the demetallized feed material obtained from the MRS operation, a wet gas product stream is formed and recovered by conduit 114, a main column overhead liquid is recovered by conduit 116, a 430° to 630° F. product fraction is recovered by conduit 118 and a 630° F.+ material stream containing both product and unconverted feed is recovered by conduit 120. The RCC conversion products recovered by conduits 118 and 120 may be used in fuel oil blending operations not shown. On the other hand, the 630° F.+ product may be further converted by catalytic cracking either in a separate FCC unit not shown or as recycle to the RCC unit 112. The 430° F. to 630° F. product in conduit 118 may also be further refined as desired to meet fuel demands as by cracking, hydrogenation, reforming and/or other processing steps suitable for the product desired.

The RCC main column overhead liquid in conduit 116 is passed to a gas concentration unit 122. The wet gases in conduits 106 and 114 are blended and also passed to unit 122 by conduct 107. The operation of the gas concentration unit provides a fuel gas stream withdrawn by conduit 124, which material is then passed to an MEA absorber 126 before being recovered by conduit 128.

A gasoline product boiling in the range of $C_5$ hydrocarbons up to about 400° to 430° F. is recovered from unit 122 by conduit 130 and passed to a gasoline treating unit 132 before being recovered by conduit 134. In gasoline treating unit 132, it is contemplated treating the gasoline with a caustic wash and an electrostatic precipitator to remove undesired impurities in a manner known in the industry.

A $C_3/C_4$ product fraction is recovered from unit 122 by conduit 136 and passed to a $C_3/C_4$ treating unit 138. In unit 138, the $C_3/C_4$ fraction is treated to remove sulfur impurities and then caustic washed. The product of treating unit 138 is passed by conduit 140 to a hydrogenation unit 142 designed to particularly accomplish hydrogenation of diolefins before being recovered by conduit 144.

Used equilibrium catalyst is withdrawn in a fully regenerated condition from the regenerated standpipe of the RCC unit and transferred via line 150 to a treatment unit 152 for impregnating the catalyst with an alkaline metal additive to neutralize its residual catalytic activity. The catalyst is preferably soaked in an aqueous solution of the select alkaline metal additive, dried and then transferred to the MRS unit 104 as makeup sorbent via line 154.

Figure 4:
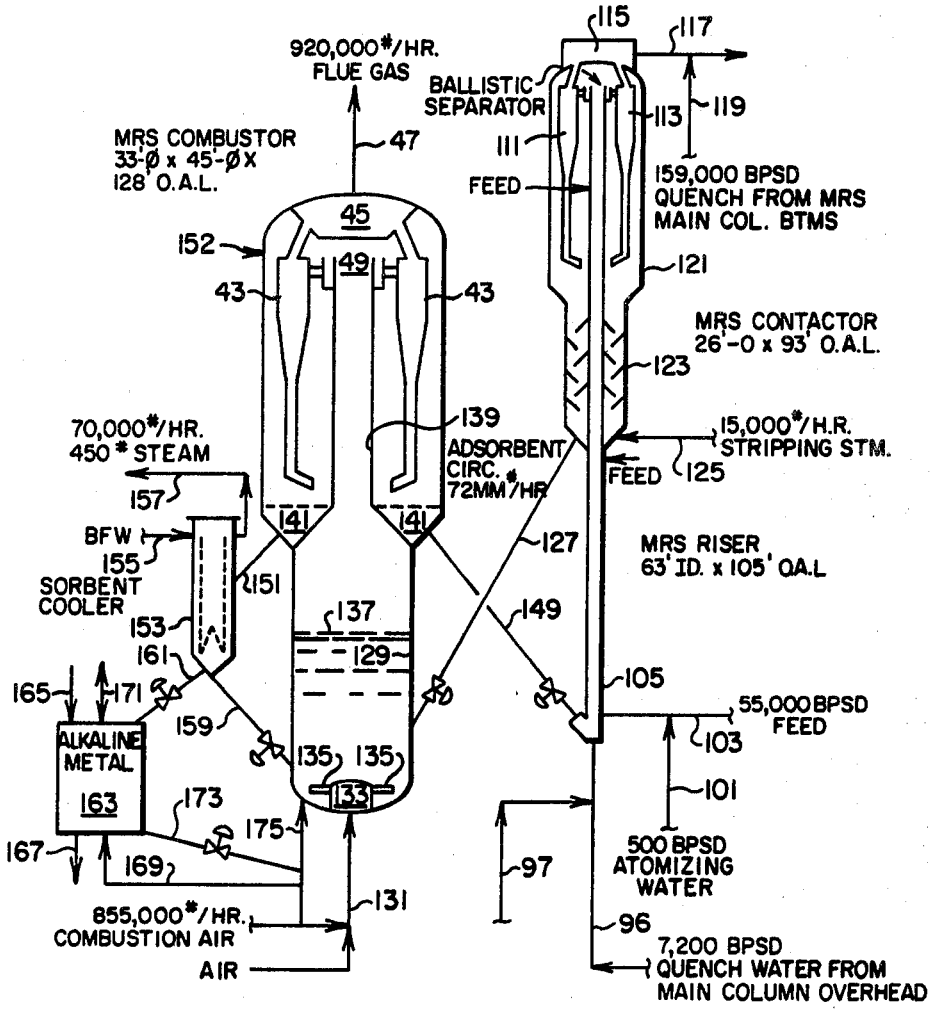
FIG. 4 is a schematic diagram of a contactor and combustor apparatus for the metals removal system (MRS) of the combined MRS-RCC complex of FIG. 3.

Referring now to FIG. 4, by way of example there is shown one arrangement of apparatus for effecting thermal contact of the residual oil or reduced crude containing feed with the solid sorbent material to accomplish metals removal and reduce the Conradson carbon producing components of the feed by thermal visbreaking. The contact system of FIG. 4 is referred to herein as the MRS system (metals removal system) and comprises a riser contact zone for selectively contacting the heavy residual oil feed with hot solid sorbent particulates comprising neutralized catalyst of little or no catalytic cracking activity. The contact temperature, space velocity conditions and hydrocarbon feed partial pressure are selected to accomplish substantial metals removal in the absence of excessive thermal cracking for the production of thermal naphtha and higher boiling range products.

In the specific arrangement of FIG. 4, atomizing water is added by conduit 101 to a reduced crude containing feed introduced by conduit 103 to a riser contactor 105 above the bottom portion thereof. Steam in conduit 97 and/or admixed with water in conduit 96 obtained from the main column overhead drum is admixed with regenerated hot solid sorbent at a temperature in the range of 1300° to 1500° F. in the bottom portion of the riser in respective amounts and under conditions selected to adjust the temperature of the hot sorbent before it contacts the oil feed charged to the contactor. This particular combination of diluents admixed with solids permits establishing a vertical velocity component in the solids before they contact dispersed hydrocarbon feed material further along the riser. The suspension of sorbent particulates and atomized feed of low partial pressure in the presence of steam diluent is passed through the riser contact zone at a temperature below about 1025° F. and at a velocity providing a hydrocarbon residence time of less than 5 seconds and preferably within the range of 0.5 to 4 seconds. The contactor 105 is provided with a plurality of vertically spaced apart feed inlet means to accomplish desired changes in hydrocarbon residence time (not shown).

The suspension passed through contactor 105 is discharged from the top or open end of the riser and vaporous hydrocarbons from thermal visbreaking and gasiform diluent material are ballistically separated from sorbent particulates in the manner previously described with reference to FIG. 2 and are caused to flow through a plurality of parallel arranged cyclone separators 111 and 113 positioned about the upper open end of the riser contact zone. Hydrocarbon vapors separated from entrained solid by the cyclone separators are collected in a plenum chamber 115 before withdrawal or recovery by conduit 117 at a temperature of about 970° F. The vaporous material in conduit 117 is quenched in one specific embodiment to a temperature of about 680° F. by admixture with a portion of the bottoms product from the main column of the MRS fractionator (not shown) which is introduced into conduit 117 through conduit 119.

Solid particulate material comprising the select sorbent of this invention and accumulated metal deposits and carbonaceous material from thermal degradation of the feed are collected in a bottom portion of sorbent separator vessel 121 which includes a stripping section 123 to which stripping gas is charged by conduit 125 at a temperature of at least about 400° F. Higher stripping temperatures up to about 1050° F. are also contemplated.

Stripped solid sorbent material is passed by standpipe 127, which is provided with a flow control valve, to a fluid bed of sorbent particulates in a bottom regeneration zone 129 of a combustor 152. Regeneration gas or combustion supporting gas, such as oxygen modified gas or air, is charged to this lower regeneration zone by a conduit 131 and through a plenum distribution chamber 133 supporting a plurality of radiating gas distributor pipes 135. Regeneration of the sorbent particles by burning off the deposited carbonaceous material is accomplished at a temperature up to about 1500° F. and preferably in an oxygen lean or restricted oxygen containing atmosphere promoting the formation of a carbon monoxide rich regeneration flue gas. Combustion product gases and sorbent pass from a dense fluild bed 137 of particulates through a restricted passageway 139 as a suspension of particulates in flue gases to an upper enlarged portion of the combustor vessel where a ballistic separation is made between solid particulates and combustion flue gases by the combination of a ballistic separator 49 of the type described in reference to FIG. 2 and cyclone separators 43,43 positioned about the open upper end of passageway 139. The separated particulate is collected as a fluid bed of material 141 in an annular zone about restricted passageway 139. Flue gases separated from the solids pass through the annular cup of ballistic separator 49 and into the cyclones 43, 43 for removal of entrained fines. The CO rich flue gases then pass to plenum chamber 45 for discharge through conduit 47. Regenerated sorbent at an elevated temperature within the range of 1000° to 1500° F. is passed by standpipe 149 to the bottom portion of riser 105 for use as herein described. A portion of the hot regenerated sorbent may be withdrawn by a conduit 151 for passage to a heat exchanger 153 wherein the sorbent may be cooled and steam generated by indirect heat exchange with boiler feed water introduced by conduit 155. The steam is recovered by conduit 157. The thus partially cooled solid particulate may be withdrawn by conduit 159 for passage to a bottom portion of the fluid bed of particulate in a bottom portion of regeneration zone 129 for temperature control of the particulate solids being regenerated.

Alternately, a slip stream of cooled sorbent may be transferred by conduit 161 to a soak vessel 163 for impregnation with a solution of the select alkaline metal additive introduced through line 165. After impregnation, the additive solution is drawn off via line 167 and the sorbent dried with hot combustion air introduced by line 169 and drawn off by vent and/or surge line 171. Dry sorbent freshly treated with alkaline metal is then returned to the combustor via a standpipe 173 and an air lift line 175.

Figure 5:
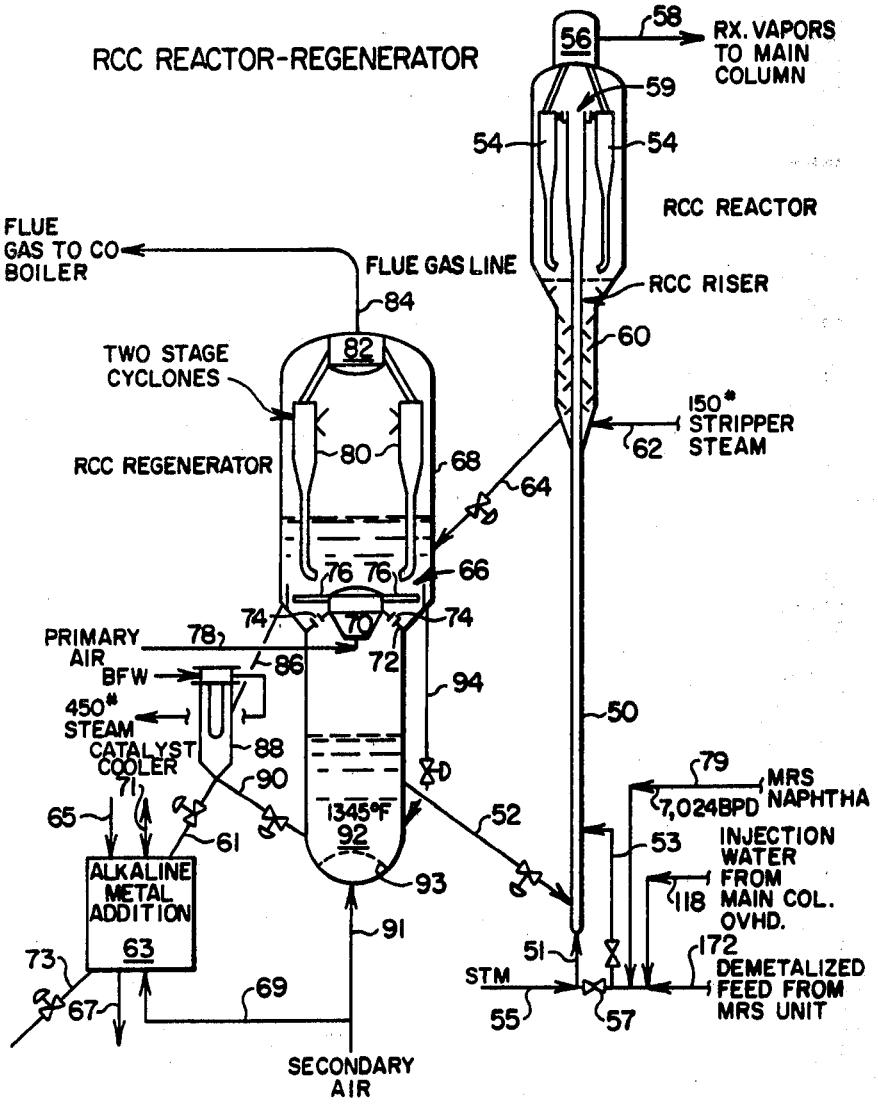
FIG. 5 is a schematic diagram of a reactor and regenerator apparatus for the reduced crude conversion (RCC) system of the combined MRS-RCC complex of FIG. 3.

Referring now to FIG. 5 there is shown an arrangement of vessels with interconnecting conduits comprising an RCC riser reactor-regenerator system relied upon to process the demetallized feed materials obtained from the MRS upgrading unit. As mentioned above, the residual metals in the RCC feed on the basis of nickel plus vanadium (Ni+V) charged to the RCC riser reactor will be considerably reduced by the MRS solids contacting unit and usually will be less than about 100 ppm, preferably less than 50 ppm and more preferably less than 25 ppm Ni+V.

The operation of the RCC system is similar in many respects to a fluid catalyst cracking (FCC) system but is more critically and selectively controlled with respect to catalyst regeneration and catalyst use in order to process carbo-metallic oils, such as reduced crudes, which have been partially demetallized and decoked as herein provided. Operation of the RCC unit is carefully controlled with respect to heat balance and feed conversion selectivity since relatively large amounts of carbonaceous deposits (coke) are laid down on the catalyst depending on the level of contaminates in the feed charge and the amount of metal deposits accumulated on the circulated catalyst. In addition, overheating and degradation of the catalyst and non-selective and/or over cracking of the feed are potentially eminent so that product selectivity may be undesirable altered when the RCC operation is permitted to vary from a relatively restricted range of operating conditions into less than an efficient and economic operation. Thus it is desirable to utilize a two stage regeneration operation in the RCC system so as to restrain the amount of heat transferred to the RCC riser cracking zone by the catalyst and yet reduce residual coke on regenerated catalyst to a desired low level, preferably less than 0.05 wt% and more preferably less than 0.01 wt%.

A particularly important feature is the identification of operating conditions in the hydrocarbon conversion riser reactor which permit processing upgraded heavy crudes under conditions particularly increasing the yield of desired liquid fuel products such as gasoline and gasiform materials readily converted to useful liquid fuel products by auxiliary processes such as alkylation, isomerization, polymerization or a combination thereof. Both the MRS and RCC riser operations are relatively high velocity operations as herein described. In the RCC system, the temperature of the conversion product vapors as measured near the riser outlet is preferably restricted to within a range of 950° F. to about 1050° F. and more preferably restricted to less than about 1000° F. when processing demetallized feed from the MRS unit. The MRS feed is charged to the RCC riser at a temperature of about 400° F. The use of water injection and steam dispersion is relied upon in substantial measure for temperature control and feed atomization and for achieving a high velocity suspension of catalyst particles and hydrocarbon feed. This velocity and the riser dimensions are such that the hydrocarbons are in contact with catalyst particles in the riser conversion zone for less than about 4 seconds, preferably less than about 3 seconds and more preferably less than about 2 seconds. Thus it is important to achieve rapid dispersion of feed, rapid contact of dispersed feed with catalyst particles and rapid separation of hydrocarbon vapors from catalyst substantially immediately upon discharge of the suspension from the riser conversion zone. In order to accomplish these objectives, the riser reactor is designed to achieve high velocity (preferably 180 ft./second or more) mixing of hot catalyst particles with fluidizing gaseous material and with charged feed material in a lower, restricted diameter portion of the riser reactor. In an upper, larger diameter portion, the velocity of the suspension is descreased to a discharge velocity of about 85 to 95 feet per second or less adjacent the upper discharge end of the riser. In the embodiment of FIG. 5, this alteration of the suspension velocity is accomplished by gradually increasing the diameter of the riser in an upper transition section thereof. In a particularly preferred arrangement, the initially formed suspension is at a velocity of about 180 feet per second and the velocity of the suspension discharged from the open upper end of the riser reactor is about 86 feet per second after passing through the gradually expanding transition section. Preferably, the discharge temperature is maintained below about 1025° F. but above about 975° F. in this specific embodiment. In the specific arrangement of FIG. 5, the riser reactor is about 198 ft. tall, of which the top 25 feet thereof is about 63 inches in diameter and connected by a 7 foot transition section to a 40 inch diameter riser tube comprising the lower section of the riser reactor.

A mixture of the demetallized 430° F. plus feed obtained from the MRS unit, the MRS naphtha and liquid water obtained from the main column overhead drum is introduced into a bottom or upper portion of the riser reactor 50 as desired using charge lines 51 or 53, respectively. Steam may be charged via line 55 to the bottom of the riser, either separately or in admixture with demetallized feed charged via line 57, to assist with atomization and/or dispersion of the heavy oil feed which contacts regenerated hot catalyst particles charged to the bottom portion of the riser by conduit 52. It is thus contemplated forming a high velocity suspension of steam and catalyst, with or without charged naphtha, in a bottom portion of the riser prior to charging the demetallized, thermally converted oil feed which may be mixed with additional quantities of water and/or steam. It is further comtemplated charging the oil feed admixed with atomizing diluent such as steam and/or naphtha through a plurality of oil feed atomizing devices (not shown) to achieve more intimate contact of the high boiling feed with hot regenerated catalyst particles. These materials form a suitable upflowing suspension in which the feed undergoes conversion to the liquid fuel products desired within the residence time and at the conversion conditions provided. The concentration of catalyst particles in the upflowing suspension is preferably within the range of about 2 to 10 lbs. per cubic ft.

Upon transversing riser 50 and being discharged from its top open end, product vapors are abruptly separated from catalyst by ballistic separator 59 which is of the type described above in reference to FIG. 2. After reversing direction and passing through separator 59, the gasiform product material comprising hydrocarbon vapors with some entrained catalyst particles passes through a plurality of parallel arranged cyclone separators 54, generally comprising one stage of cyclone separation, positioned about the upper end of the riser. However, two or more cyclone separators or stages in series may also be employed. Separated product vapors are collected in plenum chamber 56 and withdrawn therefrom by conduit 58 communicating with an RCC product recovery section which includes a main fractionator column (not shown). Catalyst particles separated from the vaporous products of hydrocarbon conversion are collected and passed downwardly through a stripping zone 60 in countercurrent relation to a stripping gas such as steam introduced by conduit 62. The temperature of the RCC stripping operation is generally maintained within the range of 900° F. to 1050° F. The stripped catalyst is passed by a standpipe conduit 64 to a bed of catalyst 66 in a first stage of catalyst regeneration affected in the upper portion of a two stage catalyst regenerator 68.

The upper stage of regenerator 68 is of larger diameter than the lower stage and the two stages are separated from one another by a centrally located air distributor having a plenum chamber 70 supported by an annular baffle 72 provided with flue gas flow through passageways 74,74. A plurality of hollow radiating arms 76 are provided on plenum 70 for distributing fresh regeneration gas to a lower portion of catalyst bed 66. In a preferred embodiment, regeneration air amounting to about 75% of that required to achieve removal of carbonaceous material to the desired level by burning is introduced to plenum chamber 70 by conduit 78. The regeneration air or other oxygen containing gas is preferably preheated by means not shown to a desired elevated temperature of about 300° F. The catalyst introduced to bed 66 by conduit 64 comprises carbonaceous deposits from the riser hydrocarbon conversion process and these deposits contain significant amounts of hydrogen which is oxidized to water at regeneration conditions.

In the first stage of catalyst regeneration, the regeneration temperature is kept to a low value, preferably in the range of about 1200° F. up to about 1300° F. under combustion supporting conditions sufficient to effect at least partial removal of the carbonaceous deposits and produce a CO rich flue gas. The CO rich flue gases, comprising $CO_2$, sulfur oxides, nitrogen and water vapor, pass from the dilute phase of the first stage through a combination of parallel arranged cyclone separators which may comprise two or more stages in series and are represented by cyclones 80 in which entrained catalyst particles are separated from flue gas and returned by the cyclone dipleg to catalyst bed 66. The CO rich flue gas separated from catalyst particles by the cyclones is passed to a plenum chamber 82 for withdrawal therefrom by a conduit 84.

The partially regenerated catalyst of bed 66 is passed to a second stage of catalyst regeneration below the first stage through an external downcomer 86 provided with a catalyst cooler 88 wherein high pressure (450 psig) steam may be generated. The catalyst, partially cooled in cooler 88 and only partially regenerated, is then passed by conduit 90 to a fluid bed of catalyst 92 in the lower portion of regeneration vessel 68. Regeneration of the catalyst is completed in bed 92 which comprises the second stage of catalyst regeneration. A standpipe 94 is also provided as a second external standpipe for transfer of catalyst from bed 66 to bed 92 without water cooling. However standpipe 86 is the primary route for catalyst transfer from bed 66 to bed 92. The purpose of these transfer standpipes is to transfer partially regenerated catalyst to and maintain temperature control in the lower regeneration stage. In this second stage, residual carbon on the catalyst is preferably burned at a temperature within the range of about 1325° up to about 1500° F. Regeneration of catalyst in bed 92 is therefore affected at a temperature generally higher than that of bed 66. Bed 92 is more preferably maintained at a temperature within the range of about 1350° to about 1400° F. and in the presence of sufficient excess oxygen to achieve very low levels of residual coke on the partially regenerated catalyst received from bed 66.

In one preferred embodiment, the amount of air or oxygen modified gas employed in the second stage of catalyst regeneration is only about 25% of that required to burn all of the coke on the catalyst entering the regenerator from line 64. This second stage regeneration gas is introduced beneath a distribution grid 93 by a conduit 91. All of the flue gas from the second stage of regeneration passes through openings 74 in baffle member 72 separating the upper stage from the lower stage. Thus the hotter flue gases of the second stage comprising CO, $CO_2$ and excess or unreacted oxygen pass into the bottom portion of bed 66 and thereby contribute heat to catalyst bed 66 and help initiate the combustion of carbonaceous deposits on incoming catalyst from conduit 64. Regenerated catalyst of relatively low residual coke, preferably below about 0.10 and more preferably below 0.05 weight percent, and at a temperature within the range of 1300° to 1500° F. is withdrawn from catalyst bed 92 for passage by standpipe 52 to a lower bottom portion of riser 50 and reuse as hereinbefore discussed.

Although used FCC catalysts may be employed as the MRS sorbent and may be preferred where they contain less heavy metal contaminants than a comparable RCC catalyst, the present invention contemplates integrated MRS and RCC systems wherein the MRS sorbent comprises an RCC catalyst withdrawn from the integrated RCC system. One embodiment of such an RCC system is illustrated in FIG. 5 wherein a side stream of cooled, partially regenerated catalyst is withdrawn and transferred by a conduit 61 to a treatment vessel 63 for impregnation with a solution of the select alkaline metal additive introduced into the vessel by line 65. After the catalyst has been immersed in the additive solution for the desired period of time, the solution is drawn off through line 67 and the resulting sorbent dried with hot combustion air introduced through line 69 and drawn off or vented through a vent or surge line 71. Dry sorbent containing an amount of alkaline metal sufficient to neutralize substantially all of the catalytic sites is then transferred to the MRS system of FIG. 4 via a sorbent transfer line or standpipe 73. This fresh makeup sorbent may be added directly to either the upper or lower stage of combustor 152 or to regenerated sorbent standpipe 149. Alternately, if neutralization of the catalytic sites has not been substantially completed in RCC treatment vessel 63, the partially neutralized catalyst may be transferred to vessel 163 in the MRS system and further impregnated with the alkaline metal solution, MRS vessel 163 comprising part of the auxiliary treatment system previously described. The invention further contemplates introducing untreated or partially treated catalyst directly into combustor 152 and/or standpipe 149 and introducing the alkaline metal solution with the oil feed of line 103 and/or the water of lines 96, 97 and/or 101 in lieu of or in addition to treating a slip stream of untreated and/or partially treated sorbent in auxiliary vessel 163.

The alkaline metal addition vessels of FIGS. 4 and 5 include valving (not shown) in the associated conduits for isolating a batch of catalyst, treating it with an alkaline metal solution at near ambient conditions, and draining off the treatment solution before the catalyst is transferred as sorbent to the MRS upgrading system. In this manner, undesirable components in the treating solution which may be detrimental either to the sorbent or to the upgrading process, such as exchanged rare earth metals or other agents capable of reactivating catalytic sites, are removed before the sorbent is added to the upgrading system. However, where the treatment solution does not contain components which might be detrimental to the sorbent or the upgrading process, the solution may be added to a moving side stream wherein untreated or partially treated catalyst is continuously drawn off from the RCC regenerator and/or the MRS combustor, treated and then continuously transferred as sorbent to the MRS system. In this alternative, the side stream vessel 63 of FIG. 5 and the slip stream vessel 163 of FIG. 4 would serve as surge vessels for contacting a fluidized volume of flowing catalyst with the treating solution as untreated and/or partially treated catalyst continuously passes through these vessels.

When treating a continuous stream of hot catalyst, the liquid component of the treating solution may vaporize upon contacting the hot catalyst so as to deposit the metal additive on catalyst particles in the continuously moving stream. One advantage of this arrangement is that the heat of vaporization of the liquid can be used to help control the temperature of the highly exothermic combustion reaction in the combustor. One disadvantage of contacting very hot catalyst is that a portion of the treating solution may be solidified before the catalyst particles can be impregnated with the alkaline metal additive. The catalyst is therefore preferably cooled by RCC cooler 88 and/or MRS cooler 153 to a temperature permitting uniform and effective impregnation without premature solidification and/or nonuniform accumulations of the additive materials. The additive materials then decompose in the combustor or regenerated sorbent standpipe so as to neutralize the active acid sites of the catalyst.

The vaporous hydrocarbon products and diluent materials of the RCC reactor are withdrawn by conduit 58 and passed to the main column of a fractionator unit (not shown) for separation by fractionation. The output of the fractionator unit is usually comprised of at least seven streams, namely, dry gas, wet gas, gasoline boiling range product material, sour water, light cycle oil (LCO), heavy cycle oil (HCO) and slurry or clarified oil. Any one or more of these output streams may be recycled to the RCC riser reactor as diluent or lift gas and/or as a further feed component undergoing cracking and/or reforming at the conversion conditions employed. The invention further contemplates substituting an FCC riser reactor and regeneration system for the RCC riser reactor and regeneration system shown in FIG. 5. The output and recycle streams of such FCC apparatuses and processes are the same as or similar to those of the RCC apparatuses and processes described herein. Another important aspect of the combination operation of this invention above discussed is concerned with the severity of the thermal upgrading relied upon in the MRS operation to provide a suitable feed for efficient conversion with a crystalline zeolite containing catalyst in the downstream RCC operation. In other words, the operating techniques of this combination of operations are concerned with affecting the catalytic conversion of a thermally prepared feed material which may still comprise a relatively high level of metal contaminants with a zeolite cracking catalyst. The crystalline zeolite is in admixture with a sorbent matrix material having a relatively large pore volume and pore dimensions and this catalyst is capable of higher heavy metal loadings than previously thought useable in such cracking operations. In this operating combination, tailoring of the operating conditions employed in the MRS feed preparation operation is made to provide a thermally processed high boiling feed for a downstream catalytic conversion step. This interrelated tailoring of operating conditions for feed preparation and utilization is adjusted dependent upon the initial composition, initial boiling point and initial level of metal and Conradson carbon contaminants of the high boiling feedstock to be upgraded, and upon the composition, boiling point and level of metal and Conradson carbon contaminates in the upgraded feed to be transferred from the MRS unit to the downstream conversion unit, which may be either an FCC unit or an RCC unit depending on these interrelated parameters. In this connection, whatever high boiling portion of a crude oil is to be upgraded as herein provided, thermal preparation of the feed may be accomplished under conditions permitting up to 50 ppm heavy metals and up to 8 wt% Conradson carbon to remain in a feed to be charged to an RCC catalytic cracking operation. It is also desirable within this processing arrangement to limit the production of thermally produced naphtha even though such thermal naphtha can be and is intended to be upgraded in the zeolite cracking operation along with the thermally demetallized higher boiling feed.

It is thus evident from the discussion above presented that the combination operation of this invention is economically attractive since it permits the use of solid particulate of fluidizable particle size for both catalytic cracking and non-catalytic upgrading under conditions of high metals loading thereby reducing solids inventory replacement. Of particular interest is the finding that such solid particulate can be used to advantage for economically preparing and processing high boiling residual portions of crude oils comprising Ni+V metal contaminants in excess of 100 ppm and Conradson carbon values in excess of 10 wt% to provide more desirable liquid fuel and lower boiling products.

EXAMPLE OF SORBENT PREPARATION

A zeolite containing catalytically active catalyst of the type previously described was charged to an RCC unit processing 200 barrels per day of reduced crude containing about 100 ppm heavy metals, which equated to about 45 nickel equivalents based on the formula described elsewhere in this specification. After processing this feed continuously for three weeks, the catalyst had dropped in activity, as measured by the ASTM D3907-80 method, from a MAT relative activity of 100% down to a MAT relative activity of 15%. The metal content of this used, less active catalyst was about 4,000 ppm Ni, 3,100 ppm Fe, 9,900 ppm V, which equates to a Ni equivalents of about 6,400 ppm metals, and the catalyst had a MAT relative activity of about 15%.

The used catalyst was then withdrawn from the RCC unit and impregnated with an alkaline metal salt as follows: To 1,244 grams of the used RCC catalyst was added 2,000 ml. of deionized water. To this slurry was added 25 grams of sodium carbonate (about 0.6 wt% sodium based on weight of catalyst) and the mixture was heated to 100° F. with stirring. After approximately 15 minutes, the excess solution was decanted and the catalyst was dried at 250° F. for two hours and calcined in air at 1000° F. for two hours. The resulting sorbent was analyzed by atomic adsorption (AA) and found to contain 1.05 wt% sodium. The sorbent was also tested by the ASTM D3907-80 MAT activity test procedure and found to have a MAT activity of 25 volume percent conversion, which equates to a MAT relative activity of 0.35% where the standard material has a MAT relative activity of 100%.

EXAMPLE OF FEED UPGRADING

Approximately 1168 grams of the select sorbent prepared as described in the foregoing example was placed in a product distribution unit (PDU) for evaluation as a sorbent to convert a high Conradson carbon-metals containing reduced crude to a low Conradson carbon-metals containing FCC or RCC feed. The PDU is a fixed bed test unit containing a fluidizable material in which a relatively large quantity of reduced crude feedstock can be processed to obtain sufficient liquid product to determine its physical properties. Over the 1168 grams of select sorbent was passed 119 grams of a reduced crude containing 23 ppm Ni, 115 ppm V, 11 ppm Fe and 23 ppm Na and having a Conradson carbon value of 7.28. The operating parameters of the contact zone were a temperature of 1000° F., a 15 second contact time between feed and sorbent and a sorbent to oil (S/O) ratio of 10. The resulting liquid product contained Ni, V, Fe and Na in amounts of less than 1 ppm each, and had a Conradson carbon value of 1.3. This represents over 99% removal of the metals and over 80% reduction in Conradson carbon content. The liquid product prepared in this test sequence is an excellent FCC feedstock and would be a premium RCC feedstock.

COMPARISON TESTING OF SORBENTS

To compare MRS operations using the select sorbent of the invention with those using prior art clay sorbents, a series of particulate "clumping" tests were performed. A clumping test is carried out as follows: A vanadia containing sorbent sample is placed in an individual ceramic crucible, dried and calcined at 1400° F. in air for two hours using a muffle furnace. At the end of the calcining period, the crucible is withdrawn from the muffle furnace and cooled to room temperature. The surface texture and flow characteristics of the sorbent particles are then observed. Surface vanadia, while liquid at the calcining temperature (1400° F.), will flow across the sorbent surface and cause sorbent particles to coalesce when cooled down below its solidification point. The degree of coalescence is a visual and mechanical estimation of particle fusion, namely, "flowing-"—no change in flow characteristics between virgin sorbent and used sorbent; "soft"—substantially all of used sorbent is free flowing with a small amount of clumps easily crushed to free flowing sorbent; "intermediate"—free flowing used sorbent contains both free flowing particles and fused masses in approximately a 1:1 ratio; and "hard"—substantially all of the used sorbent particles are fused into a hard mass with very few free flowing particles.

Figure 6:
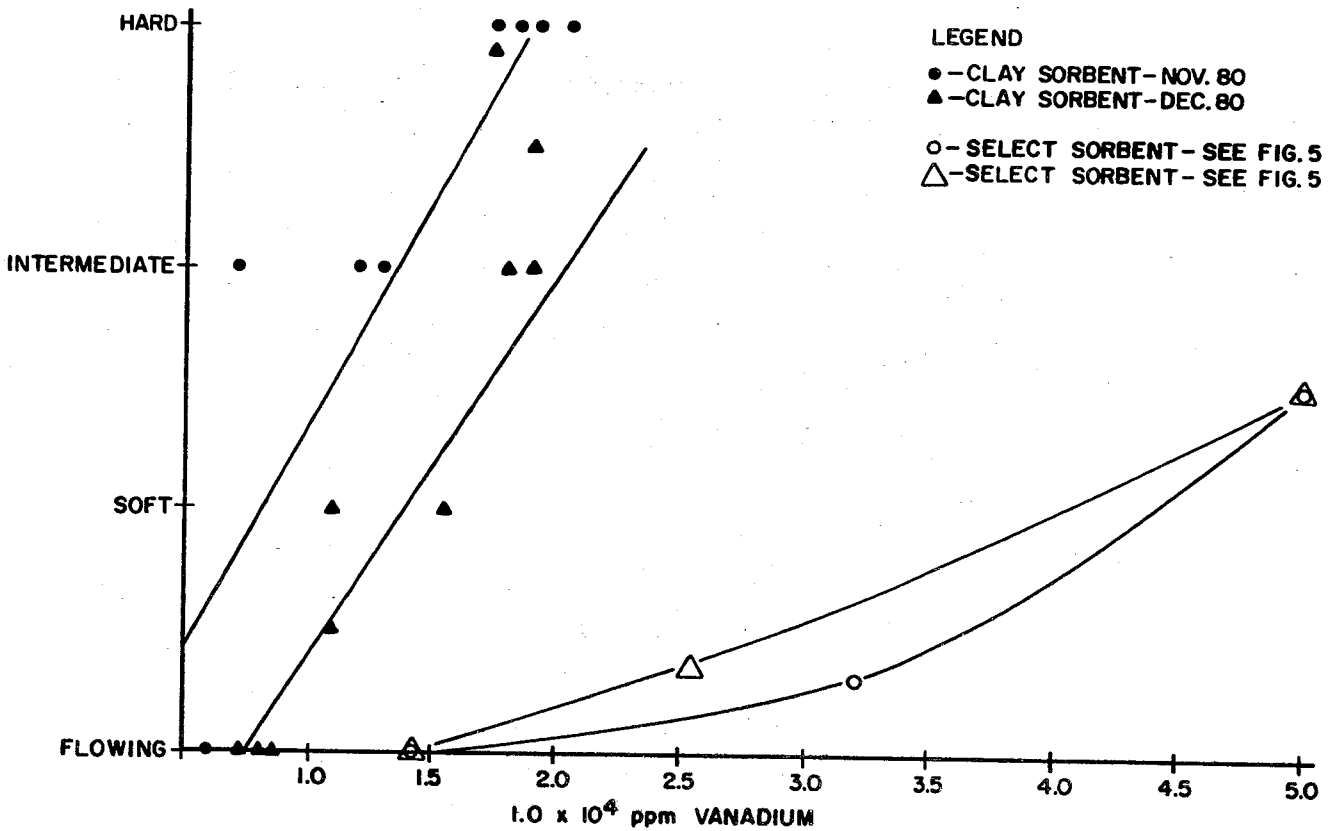
FIG. 6 is a graph illustrating the changes in particle coalescence properties with increasing amounts of vanadium both on untreated clay sorbent and on used catalyst sorbent treated with an alkaline metal additive according to the invention.

A kaolin clay, such as described in U.S. Pat. No. 4,263,128 and spray dried to yield microspherical particles in the 20 to 150 micron size range, had vanadia deposited upon it in varying concentrations by using the clay as a sorbent in the treatment of a reduced crude to lower its vanadium and Conradson carbon values. Two process runs were made with each process period extending for approximately 30 days. Samples of the clay sorbent were taken at varying vanadium levels during the two runs. With reference to FIG. 6, the solid dots and solid triangles, respectively, represent the measured levels of vanadium on the clay sorbent samples from these two processing periods. After being withdrawn from the process, each sample was subjected to the clumping test described above. A clay sample free of vanadia was also tested as a control. The surface texture and flow characteristics of the calcined samples were noted and the results of these clumping tests are reported in Table 6A.

TABLE 6A

| $V_2O_5$ Concentration - ppm | Surface Texture | Flow Characteristics |
|---|---|---|
| 0 | Free | Free flowing |
| 1,000-10,000 | Surface Clumped | Broke crust for free flowing |
| 10,000-20,000 | Surface Clumped | Total clumping no flow |

A catalytically active cracking catalyst was prepared by methods similar to those described above to yield microspherical catalyst particles in the 20 to 150 micron size range. This catalyst was utilized in an RCC process to lower its catalytic activity and then neutralized with an alkaline metal additive to yield a sorbent according to the invention. Vanadia was deposited upon samples of this sorbent in varying concentrations to simulate samples from an upgrading process and each of these samples was subjected to the clumping test described above. A sample of this sorbent free of vanadia was also tested as a control. The surface texture and flow characteristics of the calcined samples were noted and the results of these clumping tests are reported in Table 6.

TABLE 6B

| $V_2O_5$ Concentration - ppm | Surface Texture | Flow Characteristics |
|---|---|---|
| 0 | Free | Free flowing |
| 15,000 | Free | Free flowing |
| 20,000 | Free | Free flowing |
| 30,000 | Surface clumped | Broke crust for free flowing |
| 40,000 | Surface clumped | Partial flowing |
| 50,000 | Surface clumped | Total clumping No flowing |

A comparison between the results obtained with the select sorbent of this invention and those obtained with the conventional clay sorbent is shown in FIG. 6. As also shown in Table 6A, the clay free of vanadia does not form any crust or clumps or fused particles at the temperatures encountered in the regeneration zone of the upgrading process of the invention. At vanadia concentrations of 1,000–10,000 ppm, clumping was observed but the vanadia crusts binding paarticles together could be readily broken into free flowing, crusty particles. The conventional clay sorbent particles began to show significant coalescence properties at vanadium levels of about 10,000 ppm and above, and by 20,000 ppm had coalesced into a hard mass evidencing a complete loss of fluidization properties.

Manifestation of the foregoing phenomena is further demonstrated by the finding that when coalesced clay particles of high vanadium content (10,000 ppm or more) are cooled down from a temperature above the solidification temperature of vanadium pentoxide in an operating MRS unit in order to permit entrance into the unit for cleaning out plugged diplegs and other repairs, a solid mass of sorbent which must be forcibly removed has been observed. This phenomena makes turn-around lengthy and complex for the operating unit since this material must be chipped out.

In comparison, significant particle coalescence of the select sorbent of the invention does not begin until a vanadium level of about 25,000 to 30,000 ppm is reached, as opposed to significant coalescence of the conventional sorbent at about 10,000 ppm vanadium. Whereas the conventional clay sorbent is totally clumped and not free flowing at 20,000 ppm V, the sorbent of the invention is still free flowing at 30,000 ppm and does not experience total clumping until about 50,000 ppm V.

INDUSTRIAL APPLICABILITY

The invention is useful in the treatment of both FCC and RCC feedstocks as described above. It is particularly useful in the treatment of high boiling, carbo-metallic feedstocks of extremely high metals and/or Conradson carbon values to provide products of lower metals and/or Conradson carbon values suitable for use as feeds for FCC and/or RCC units. Examples of these oils are reduced crudes and other crude oils or crude oil fractions containing metals and/or residua as above defined.

Although the upgrading process is preferably conducted in a riser reactor of the vented type, other types of risers and other types of reactors with either upward or downward flow may be employed. For example, the upgrading operation may be conducted with a moving bed of sorbent which moves in countercurrent relation to liquid (unvaporized) feedstock under suitable contact conditions of pressure, temperature and weight hourly space velocity. The process conditions, sorbent and feed flows and schematic flow arrangement of such a moving bed operation are described in the literature, such as for example, in the article entitled, "T. C. Reforming", Pet. Engr., April 1954; and in the article entitled "Hyperforming", Pet. Engr., April 1954; the entire disclosures of said articles being incorporated herein by reference.

The economic advantages of the invention include the utilization of cheap materials, such as deactivated, spent or equilibrium FCC or RCC catalysts valued at $100 to $300 per ton, instead of freshly prepared clay sorbents valued at $800 to $1,000 per ton.

In the upgrading of various feeds, the rate of vanadium buildup on the sorbent and the equilibrium or steady state level of vanadium on the sorbent are functions of the vanadium content of the feed and especially the sorbent replacement rate at equilibrium conditions. Table 7 presents a typical case for a 40,000 bbl/day MRS unit in which the vanadium content of the feed in varied from 1 ppm, representative of upgrading an FCC feedstock of VGO and 5 to 20 percent of a heavy hydrocarbon fraction, up to a range of 25 to 400 ppm, representative of upgrading an RCC feedstock comprised of 70 to 100 percent of a reduced crude. In order to maintain various levels of vanadium on the sorbent at an equilibrium state achieved after long term operation (50 to 150 days), this sorbent replacement rate may be varied to yield equilibriated vanadium values of 5,000; 10,000; 20,000 and 30,000 ppm. As explained elsewhere, vanadium, as vanadium pentoxide on regenerated sorbent, may undergo melting at regenerator temperatures and, at these metal levels, may flow across the sorbent surface, causing particle fusion and coalescence.

For example, at 1,000 ppm vanadium on a clay sorbent, this phenomena begins to be observed and by 10,000 ppm vanadium, clay particle coalescence becomes a major factor in unit operation. By utilizing the sorbent of the present invention, one can now operate an upgrading unit with sorbent in the upper ranges of vanadium levels (30,000–40,000 ppm) without vanadium deposition causing particle coalescence or excessive sintering of the sorbent structure.

TABLE 7

Sorbent Addition Rates For Holding Given Vanadium Levels On Sorbent For Feeds With Varying Vanadium Content. 40,000 BBL/DAY UNIT

| Total Vanadium in Feed PPM | lbs Metal Day | | | | |
|---|---|---|---|---|---|
| | Level on Equilibrium Sorbent | | | | |
| 5,000 | 10,000 | 20,000 | 30,000 | | PPM |
| 0.5 | 1.0 | 2.0 | 3.0 | | WT % |
| | Daily Tonnage Replacement | | | | |
| 400 | 5200 | 500 | 250 | 125 | 82 |
| 200 | 2600 | 250 | 125 | 65 | 42 |
| 100 | 1300 | 125 | 63 | 32 | 21 |
| 50 | 650 | 63 | 32 | 16 | 10 |
| 25 | 325 | 32 | 16 | 8 | 5 |
| 1 | 13 | 1.25 | 0.63 | 0.32 | 0.21 |

Table 8 demonstrates the economic differential (savings in dollars per day) that can be realized by utilizing the sorbent of this invention and operating at the 30,000 ppm level versus the 10,000 ppm level of vanadium on sorbent. The costs of virgin sorbent as given in Notes (2) and (4) of Table 8 are based on quoted prices for clay sorbents and used catalysts which are commercially available at the present time. As shown in Table 8, upgrading of a feedstock having 1 ppm vanadium for FCC operations with the sorbent of the invention would result in a savings of about $504/day. In comparison, upgrading a heavy hydrocarbon oil containing 25 to 100 ppm vanadium for RCC operations utilizing the sorbent of the invention would result in a savings of about $12,900 to about $50,400 per day, depending on the vanadium content of the feedstock.

TABLE 8

| Metals In Feed, Ppm | Feed - 40,000 Bbl/Day; 1 Bbl = 335 Lbs: Sorbent Add'n Rate To Maintain 10,000 Ppm V(1) Tons/Day | Cost $/Day(2) | Sorbent Add'n Rate To Maintain 30,000 Ppm V(2) Ton/Day | Cost $/Day(4) | Savings $/Day(5) |
|---|---|---|---|---|---|
| 1 | 0.63 | 567 | 0.21 | 63 | 504 |
| 25 | 16 | 14,400 | 5 | 1,500 | 12,900 |
| 50 | 32 | 28,800 | 10 | 3,000 | 25,800 |
| 100 | 63 | 56,700 | 21 | 6,300 | 50,400 |

(1)Based on sorbent coalescence at this level for that material described in literature
(2)Sorbent cost of 45¢/lb.
(3)Based on sorbent of the invention coalescing at this level
(4)Sorbent cost of 15¢/lb.
(5)Saving is equal to (2) minus (4)

What is claimed is:

1. A process for upgrading residual oil portions of crude oils comprising metal contaminants and Conradson carbon producing components to provide an upgraded residual oil product reduced in metal contaminants and Conradson carbon producing components which comprises, (a) contacting at an elevated temperature said residual portions of crude oil with solid sorbent particle material of relatively high pore volume and surface area sufficient to immobilize deposited vanadium compounds by adsorption thereof within the pore structure of said sorbent particle during said contacting, (b) said sorbent particle being selected from one of deactivated, spent or equilibrium cracking catalyst which has been treated with one or a combination of alkali metal compounds in an amount sufficient to neutralize available acid cracking sites therein and yield a deactivated cracking catalyst sorbent material with essentially no significant cracking activity of high pore volume and surface area, and (c) using said deactivated cracking catalyst sorbent material of step (b) in step (a) above.

2. The process of claim 1 wherein the amount of said added alkaline metal is sufficient to lower the MAT activity of said catalyst by at least about 25 volume percent conversion.

3. The process of claim 2 wherein the amount of said added alkaline metal is sufficient to lower said MAT activity by at least about 35 volume percent conversion.

4. The process of claim 1 wherein the MAT activity of said sorbent is in the range of about 0 to about 10 volume percent conversion.

5. The process of claim 1 wherein the sorbent material comprises catalyst particles withdrawn from an FCC and/or a RCC cracking operation of substantially reduced cracking activity and which is deactivated catalytically with an alkaline metal additive so as to provide a MAT relative activity of less than about 1.0.

6. The process of claim 1 wherein said vanadium compounds comprise vanadium oxides, sulfides, sulfites, sulfates or oxysulfides.

7. The process of claim 1 wherein the sorbent comprises a deactivated, spent or equilibrium catalyst withdrawn from an FCC or RCC cracking operation and treated with an alkaline metal additive so as to have a MAT relative activity in the range of about 0 to about 0.1%.

8. The process of claim 1 wherein the oil feed is a reduced crude or crude oil containing 100 ppm or more of metals comprised of nickel, vanadium, iron or copper and having a Conradson carbon value of 8 wt% or more.

9. The process of claim 1 wherein the addition of the alkaline metal compound may be made during the contact step for upgrading the residual oil feed, by treatment of deactivated catalyst particles and/or prior to use in said residual oil upgrading contact step.

10. The process of claim 1 wherein the sorbent particle material is of a particle size for use in a fluid or moving bed solid particle contact operation.

11. The process of claim 1 wherein said upgraded product contains 50 ppm or less of metals and less than 8 wt% Conradson carbon.

12. The process of claim 1 wherein said residual oil feed contains sodium salts in a concentration in the range of about 1 ppm to about 50 ppm.

13. The process of claim 1 wherein the residual oil feed comprises gas oil, about 0 to about 25 weight percent of a reduced crude, more than about 0.1 ppm vanadium and has a Conradson carbon value greater than about 1.0.

14. The process of claim 1 wherein said oil feed is a reduced crude or crude oil containing 75 ppm or more of vanadium and having a Conradson carbon value of 10 wt% or more.

15. The process of claim 1 wherein said sorbent is prepared from a catalytic material comprised of a zeolite in a matrix composition, and has a surface area of at least 20 $m^2/g$ and a pore volume of at least 0.2 cc/g.

16. The process of claim 1 wherein said sorbent is in a spherical form and ranges in size from about 10 to about 200 microns, and wherein said upgrading zone comprises a riser transfer zone.

17. The process of claim 1 wherein said sorbent ranges in size from about 200 microns to about ¼ inch, and wherein said upgrading zone comprises a moving bed contact zone.

18. The process of claim 1 wherein prior to addition of said alkaline metal compound said catalyst contained from 1 to 20 weight percent of a catalytically active aluminosilicate zeolite.

19. The process of claim 1 wherein the upgraded product of said residual oil feed is subsequently contacted with an active conversion catalyst in a catalytic conversion process to produce gasoline boiling range product of improved octane rating.

20. The process of claim 1 wherein said added alkaline metal comprises Li, Na, K, Rb, Cs, Mg, Ca, Sr, or Ba.

21. The process of claim 1 wherein said alkaline metal is present in the sorbent in the range of about 0.2 to about 5 wt.%.

22. The process of claim 1 wherein prior to addition of said alkaline metal said catalyst comprises an aluminosilicate zeolite embedded in a catalytically active matrix.

23. The process of claim 1 wherein prior to addition of said alkaline metal said catalyst comprises a catalytically active amorphous silica-alumina material containing no zeolite.

24. The process of claim 23 wherein said catalytically active amorphous silica-alumina material is promoted with titania, zirconia or magnesia or a combination of 2 or more of said promoters.

25. The process of claim 1 wherein said alkaline metal is introduced into said catalyst by contacting said catalyst with an aqueous solution of a salt of said alkaline metal or a hydrocarbon solution of an organo-metallic compound of said alkaline metal during one or more steps of said upgrading process.

26. The process of claim 1 wherein said deposited metals include vanadium deposited on said sorbent in concentration ranges of about 0.05 to 5 wt% based on weight of sorbent.

27. The process of claim 1 wherein said oil feed contains both nickel and vanadium and the weight ratio of said vandium to said nickel is in the range of about 1:3 to about 5:1.

28. The process of claim 1 wherein said oil feed has a significant content of heavy metals, including vanadium, and the vanadium proportion of said heavy metals content is greater than fifty percent.

29. The process of claim 1 wherein said alkaline metal is added to said catalyst as a water soluble inorganic alkaline metal salt comprised of a halide, nitrate, sulfate, sulfite, or carbonate or a combination of two or more of said alkaline metal salts.

30. The process of claim 1 wherein said alkaline metal is added to said catalyst as a hydrocarbon soluble alkaline metal compound comprised of an alcoholate, ester, phenolate, naphthenate, carboxylate or dienyl sandwich compound, or a combination of two or more of said alkaline metal compounds.

31. The process of claim 1 wherein the residual acidity of the catalyst is determined and said alkaline metal is added to the catalyst in an amount sufficient to give an alkaline neutralization ratio of at least about 1:1.

32. The process of claim 1 wherein the residual acidity of the catalyst is determined and said alkaline metal is added to the catalyst in an amount sufficient to give an alkaline neutralization ratio in the range of about 1.2 to about 2.0.

33. The process of claim 1 wherein said alkaline metal comprises Na, K, Mg, Ca, Ba, or a combination of two or more of said alkaline metals.

* * * * *